US007212923B2

(12) United States Patent
Gibbs et al.

(10) Patent No.: US 7,212,923 B2
(45) Date of Patent: May 1, 2007

(54) INFERRED PRODUCTION RATES OF A ROD PUMPED WELL FROM SURFACE AND PUMP CARD INFORMATION

(75) Inventors: Sam G. Gibbs, Midland, TX (US); Kenneth B. Nolen, Midland, TX (US)

(73) Assignee: Lufkin Industries, Inc., Lufkin, TX (US)

( * ) Notice: Subject to any disclaimer, the term of this patent is extended or adjusted under 35 U.S.C. 154(b) by 67 days.

(21) Appl. No.: 10/940,273

(22) Filed: Jan. 5, 2005

(65) Prior Publication Data

US 2006/0149476 A1 Jul. 6, 2006

(51) Int. Cl.
*G01V 9/00* (2006.01)

(52) U.S. Cl. ..... 702/13

(58) Field of Classification Search ..... 702/6, 702/12, 13; 703/10

See application file for complete search history.

(56) References Cited

U.S. PATENT DOCUMENTS 5,252,031 A 10/1993 Gibbs
5,464,058 A 11/1995 McCoy et al.
5,715,890 A 2/1998 Nolen

OTHER PUBLICATIONS

S. G. Gibbs, Utility of Motor-Speed Measurements in Pumping-Well Analysis and Control, SPE Production Engineer, Aug. 1987.

Kenneth B. Nolen and Sam G. Gibbs, Quantitative Determination of Rod-Pumpsed Leakage with Dynamometer Techniques, SPE Production Engineer, Aug. 1990.

J. C. Luppens, Practical Automation for Mature Producing Areas, Society of Petroleum Engineers, Oct. 1993.

Andy C. Eckel, Harold P. Abels, Ross A. Merritt, Testing and Practically Applying Pump-Off Controllers in a Waterflood, Society of Petroleum Engineers, Mar. 1995.

K. B. Nolen and S. G. Gibbs, Measurement and Interpretation of Fluid Levels Obtained by Venting Casing Gas, Society of Petroleum Engineers, Oct. 1997.

SAM (TM) Well Manager Rod Pump Controller, Lufkin Automation Brochure, 2002.

SROD (TM) and DIAG (TM) Rod Pumping Design & Analysis Software, Lufkin Automation Brochure, 2003.

The Lufkin AutoGraph Newsletter, Lufkin Automation, 2003.

*Primary Examiner*—Donald McElheny, Jr.
(74) *Attorney, Agent, or Firm*—Gary L. Bush, Esq.; Andrews Kurth LLP

(57) ABSTRACT

A method for inferring production of a rod pumped well. Inferred production is estimated in a well manager which not only performs pump-off control with a down-hole pump card, but also estimates liquid (oil-water) and gas production using the subsurface pump as a meter. Methods are incorporated in the well manager for identifying and quantifying several conditions: pump leakage, unanchored tubing, free gas and oil shrinkage. Quantifying such conditions in the well manger enables accurate inferring of production thereby eliminating the need for traditional well tests.

13 Claims, 17 Drawing Sheets max sfc load (lbs) : 26303
min sfc load (lbs) : 7104 max vel (in/sec) : 84.0
min vel (in/sec) : -104.1

INFERRED PRODUCTION RATES OF A ROD PUMPED WELL FROM SURFACE AND PUMP CARD INFORMATION

BACKGROUND OF THE INVENTION

1. Field of the Invention

This invention relates generally to oilfield equipment for monitoring and controlling wells that are produced by rod pumping where subsurface fluid pumps are driven via a rod string which is reciprocated by a pumping, unit located at the surface. The pumping unit may be of the predominate beam type or any other type that reciprocates the rod string.

In particular, this invention concerns using a down hole dynagraph, i.e., a pump card, with information as to the size of the down hole pump, to infer automatically the hydrocarbon production of the well.

Still more particularly, the invention concerns methods for use in a Well Monitor Controller where surface and pump cards are produced, whereby traditional well tests of a producing well can be eliminated.

2. Description of the Prior Art

Traditional Production Testing

A production test is a time-honored procedure in oil producing operations. It is involved in several activities including operation of the oilfield as a business venture, governmental regulation, well troubleshooting, and reserve estimates. With respect to its business role, it provides for division of leaseholder royalties and costs. To encourage prudent operation and enhance the stability of the nation, conservation authorities usually require periodic production tests. Also the production test is employed as a diagnostic indicator which calls attention to well problems that need to be addressed. It is important in reserve estimates, because cumulative production from each well needs to be known.

The use of the production test as a diagnostic indicator is perhaps the most recognized application among production specialists. A decline in production rate compared with a previous test can indicate a mechanical problem. The down hole pump may be worn or a tubing leak may have developed. The mechanical malfunction should be identified and remedied. The decline may also be caused by a change in reservoir conditions in the drainage area of the well. The receptivity of an offset injection well may have diminished. This may have resulted in a producing pressure decline and a decrease in production rate. The problem in the secondary recovery system should be rectified.

Conversely, an increase in productivity as measured by a well test may indicate that the well is responding to secondary recovery efforts. In this case, the well should be pumped more aggressively to obtain the increased production that is available.

The production test is a good tool for sensing that a change in the well has occurred, but it does not pinpoint the exact reason for the change. Usually a unique cause and effect relationship does not exist between a change in production rate and its cause. Because different causes may lead to the same effect, ambiguity exists. For example, a production decrease can have any number of causes such as a worn pump, a tubing leak, a failed tubing anchor, the onset of free gas production, secondary recovery deficiency, etc.

In the early years of the oil industry, each well had its own tankage and oil-gas-water separation equipment. The well was tested by measuring daily production into its tank. To decrease capital and operating costs, the handling and measurement system evolved into a centralized facility with flow lines extending from the individual wells. Production from the individual wells comes to a header. At the header a given well is placed either "on test" or has its production sent with that of other wells through a separate facility for separating and treating salable products. Ultimately the oil produced from the well(s) on test is combined with production from the remainder of the wells. The total production is then measured a final time and sold. The individual well test is used to determine the contribution of the subject well to total production from the lease 230. As mentioned previously, individual well tests are also used to equitably divide operating costs between the wells and to provide information for reserve estimates 230.

Meter malfunction is a significant problem for traditional production tests. In addition, the well test can be wrong even when the meters are working perfectly. Actual production is normally much lower than the test, primarily because of down time for equipment failures or other reasons. In principle, downtime is noted and accounted for, but down time measurement accuracy is poor. Downtime is often neglected entirely. The net effect is that traditional tests and actual production from individual wells can differ substantially, as much as from 10 to 20 percent. Accurately knowing actual production from each well is not only important for effective production operations but is also important for reservoir management 230.

Well test systems have evolved significantly. Automatically controlled diverting valves have replaced manual valves. Computers for scheduling well tests have been introduced. Significant improvements in the accuracy and reliability of measuring devices have also been made. Traditional production testing has come a long way since the pumper manually operated the system and recorded the results in an oily notebook with a stubby pencil.

Diagnostic Methods

As mentioned above, a production test has been used as a diagnostic tool to discover that a change has occurred in the well 230. The test itself does not point to the cause for the change. To determine specific cause(s) for change, diagnostic methods are employed. The best diagnostic methods are based on dynamometer analyses. Trial and error searches with the service rig (pulling unit) can also be used, but these searches are more costly to perform. Trial and error solutions require more time, and revenue is lost before the problem is identified.

Like the production test, a fluid level instrument is not capable of identifying the specific cause for a change. A change in fluid level can indicate several causes. If a relatively high fluid level is found, for example, the well operator only knows that the well is not producing at capacity. More investigation with diagnostic methods is required to identify the cause: it could be a worn pump, tubing leak, secondary recovery problem or something else.

Modern diagnostic analysis with the dynamometer began in the 1960's. The epochal development was the method for inferring the down hole pump card from surface dynamometer data. It was described in U.S. Pat. No. 3,343,409 (Gibbs). The down hole pump card (hereinafter called the "pump card") was originally introduced in 1936. It was measured directly with a dynamometer located at the subsurface pump. The measured pump card had to be retrieved by a costly process of pulling the rods and pump. By 1960, computers were available which could solve the complicated equations required to calculate the pump card from data measured at the surface of the well. To produce the pump card 212, solutions to the wave equation are obtained which satisfy dynamometer time histories of surface rod load 208 and position 210.

Qualitative Evaluation of Down Hole Pump from the Shape of Pump Card

The pump card is very useful. Its shape reveals defective pumps, completely filled pumps, gassy or pounding wells, unanchored tubing, parted rods, etc. The pump card can also be used to compute producing pressure, liquid and gas throughput, and oil shrinkage effects. It can also be used to sense tubing leaks.

Quantitative Determination of Pump Leakage

Quantitative computation of pump leakage from pump cards was described in "*Quantitative Determination of Rod-Pump. Leakage with Dynamometer Techniques*", Nolen, Gibbs, SPE Production Engineering, August 1990. Prior to this work, pump mechanical condition was obtained by (1) pulling the pump or (2) comparing the production test with estimates of pump capacity or (3) qualitative eyeballing of valve leakage rates measured with the dynamometer. The quantitative methods of Nolen and Gibbs to determine leakage involved use of scaled traveling or standing valve tests and information as to the manner in which the surface unit stops when turned off and information as to: the pump velocity measured from the pump card. These methods are discussed below in greater detail.

Pump Off Control Technology

Pump off control (POC) attained status as a viable method in the early 1970's. It was originally intended merely for stopping the well to prevent the mechanical damage of fluid pound and the power waste associated with operating an incompletely filled pump. From this humble beginning, the POC evolved into a distributed diagnostic system with well management capabilities 230. Gradually the phrase "pump off control" was replaced with terms like "Well Manager," "Pump Rod Controller," etc. (Lufkin Automation uses the trademark SAM to identify its Well Manager system). These new terms imply more than pump off control. The modern systems include diagnostic capability, collection and analysis of performance data and operation of the well in an economic fashion 230. The term WM is used below in this specification as an abbreviation for Well Manager of the type presently available through Lufkin Automation.

Over the years, POCs have used different algorithms to sense pump off. Some of these involve surface load change, motor current, motor speed, set points, dynamometer card area, and the down hole pump card. U.S. Pat. No. 5,252,031 to Gibbs describes pump off control through the use of "pump" cards. Because of its ability to sense liquid and gas throughput using the subsurface pump as a meter, POCs which use the pump card for control are desired for implementing Inferred Production (IP).

Inferred Production (IP) using a POC Well Manager (WM)

Current WMs infer production rate with considerable accuracy by using the subsurface pump as a flow meter. In other words inferred production (IP) can be determined without continuous use of traditional metering equipment. The current WM accumulates inferred fluid production with time and displays it for (1) manual recording and dissemination or (2) automatic transmittal to a central location via SCADA. A SCADA or telemetry system is helpful but not an absolute requirement. The WM always displays inferred production that can be retrieved during periodic visits by the pumper. However when a group of pumping wells is already under SCADA surveillance, IP is interfaced with SCADA for unattended telemetry of inferred production to a central collection point. The pump card based WM excels in the IP application over a SCADA produced pump card system. This is because the WM is monitoring its well continuously, stroke after stroke. The SCADA system can interrogate the well only a few times each day to retrieve dynamometer data. Therefore down hole or "pump" cards can be computed in SCADA only a few times each day. This causes errors in inferred production, particularly in wells where pump fillage varies rapidly.

Even in its incomplete state, the present system of gathering production data has the advantage of providing continuous well tests. This decreases the time lag between discovery and remediation of problems that affect production. Traditional well tests are often brief in duration (4 hours or less). In many cases these are not representative of true production rate. If the test system is serving a large number of wells, the traditional tests are infrequent, maybe only monthly. This acts to increase the time lapse between problem discovery and remediation.

It is important to identify the assumptions upon which a production test is inferred with a current prior art system.

1) The pump is in good mechanical condition and leakage is minimal.
2) The tubing is anchored at or near the pump.
3) Free gas volume in the pump is negligible at the time of traveling valve (TV) opening.
4) Oil shrinkage effects are negligible.

FIG. 1 shows a typical rod pumping system, generally indicated by reference number 10, including a prime mover 12, typically an electric motor. The power output from the prime mover 12 is transmitted by a belt 14 to a gear box unit 16. The gear box unit 16 reduces the rotational speed generated by prime mover 12 and imparts a rotary motion to a pumping unit counterbalance, a counterweight 18, and to a crank arm 20 which is journaled to a crank shaft end 22 of gear box unit 16. The rotary motion of crank arm 20 is converted to reciprocating motion by means of a walking beam 24. Crank arm 20 is connected to walking beam 24 by means of a Pitman 26. A walking horsehead 28 and a cable 30 hang a polished rod 32 which extends through a stuffing box 34.

A rod string 36 of sucker rods hangs from polished rod 32 within a tubing 38 located in a casing 40. Tubing 38 can be held stationary to casing 40 by anchor 37. The rod string 36 is connected to a plunger 42 of a subsurface pump 44. Pump 44 includes a traveling valve 46, a standing valve 48 and a pump barrel 50. In a reciprocation cycle of the structure, including the walking beam 24, polished rod 32, rod string 36 and pump plunger 42, fluids are lifted on the upstroke. When pump fillage occurs on the upstroke between the traveling valve 46 and the standing valve 48, the fluid is trapped above the standing valve 48. A portion of this fluid is displaced above the traveling valve 46 when the traveling valve moves down. Then, this fluid is lifted toward the surface on the upstroke. A schematic description of pump valve operation is illustrated in FIGS. 2A and 2B.

As shown in FIG. 2A, when the rod string 36 is in an upstroke, the traveling valve 46 is closed and the fluid is lifted upward in the tubing 38. During the upstroke, fluid is drawn upward into the pump barrel 50 through the open standing valve 48. Referring to FIG. 2B for a description of the down stroke, as the plunger 42 is lowered, the traveling valve 46 is open thereby permitting fluid within the pump barrel 50 to pass through the valve to allow the plunger 42 to move downward. The fluid within the tubing 38 and the barrel 50 is held fixed in place by the closed standing valve 48. The rod string 36 does not carry any weight of fluid during the down stroke, but does lift the entire column of fluid during the upstroke.

A well manager unit 52 (see FIG. 1) receives or derives surface rod and load information 210, 208 (or equivalent measurements), draws a surface card and computes a pump card 212. Information about the subsurface pump 44, including surface and pump cards can be sent to a central location via telemetry equipment including antenna 54.

A current Inferred Production System can be described by reference to FIGS. 3 and 4. These Figures show traveling and standing valve action and the shape of typical pump cards that are computed by WM 52. FIG. 3E shows the familiar rectangular pump card shape 500 indicating full liquid fillage of the pump. FIG. 3F depicts a "fluid pound" card 510 showing incomplete liquid fillage. In both cases the pump is in good mechanical condition and the tubing is anchored near the pump. At low producing pressure, oil shrinkage effects and the volume of free gas at TV opening are negligible. Under pump off control, the pump normally fills completely with liquid for a time after startup. At a later time depending upon the well, pump fillage decreases and fluid pound develops. Eventually the WM 52 will stop the pumping unit 10 to prevent waste of power and the damaging effects of fluid pound. In FIG. 3E the gross stroke $S_g$ and the net stroke $S_n$ are shown. When the pump is filling completely with liquid, there is no free gas passing through the pump and $S_n=S_g$. The net liquid stroke is the distance traveled by the pump from TV opening (Point C) to the bottom of its stroke (Point D) FIG. 3E.

FIG. 3F represents the situation of an incompletely filled pump with a volume of liquid and low pressure free gas therein. At point B, the pump is at top of its stroke, and the standing valve (SV) has just closed. FIG. 3D. Later, on the down stroke (Point C) the traveling valve opens. The free gas has been compressed into a tiny volume that satisfies Assumption 3. The computer in the WM 52 is programmed to determine 214 when the traveling valve opens. Thus, the net liquid stroke is defined 232 with little error as the distance the pump travels from TV opening to the bottom of its stroke. See $S_n$ in FIG. 3F.

In most cases the shut-down criterion for pump off control is based on liquid fillage of the pump. Fillage is defined as $$\Phi = \frac{100 S_n}{S_g} \tag{1}$$

in which Θ is fillage percentage. The term fillage is defined by equation 1, and is commonly used and understood by practioners of rod pumping. The shut down percentage is chosen by the well technician and causes the WM 52 to stop the unit 10 when the calculated fillage drops below a preset value. For example a cut-off fillage of 90 percent causes the unit to shut down when liquid fillage drops below 90 percent of the full barrel volume. The digital computer in the WM is programmed to recognize when the traveling valve 46 opens, and this helps define the net liquid stroke $S_n$.

Using the Subsurface Pump as a Meter

The subsurface pump can be used as a meter to measure liquid and gas volumes. On a given stroke, the liquid volume (oil and water) passing through the pump is $$\Delta V_l = \frac{\pi}{4} d^2 S_n \tag{2}$$

in which $\Delta V_1$ is measured in cubic inches and d is the diameter of the pump measured in inches. Equation 2 is the formula for computing the volume of a cylinder of diameter d and height $S_n$. If the unit 10 is turned off by the WM 52, the liquid volume is $$\Delta V_1 = 0$$

The prior art WM 52 is programmed to obtain an estimate of liquid production passing through the pump in an interval of time. Stroke after stroke the WM derives the liquid stroke (i.e., $S_n$ from FIG. 3E or 3F) from the pump card and computes the liquid volume from Equation (2). It accumulates (integrates) the liquid volumes during pumping strokes, whatever the fillage. The WM 52 has information when the unit 10 is stopped and no fluid is passing through the pump. The WM controls when the unit runs and when it is stopped. When 24 hours have passed, the WM 52 computes the inferred daily production rate $R_{IP}$ 228 in barrels per day from the elapsed time and accumulated volumes. This is expressed analytically as, $$R_{IP} = 8.905 \frac{\sum \Delta V_l}{(T_d + T_p)} \tag{3a}$$

in which $T_d$ and $T_p$ are the accumulated downtimes and pumping times during the day, expressed in seconds. The coefficient 8.905 converts cubic inches per second into barrels per day. The integrated volume of liquid passing through the pump, stroke after stroke, is the sum, $\Sigma\Delta V_1$.

Equation (3a) defines the prior art method for Inferred Production IP of liquids using the WM 52 or unit 10. Such equation, as described above, is based on assumptions of (1) negligible pump leakage, (2) anchored tubing, (3) negligible free gas volume in pump at time of traveling valve (TV) opening, and (4) oil shrinkage effects are negligible.

The prior art method for determining liquid volume daily production rate $R_{IP}$ (equation 3a) has been to provide a "k" factor to account for differences between measured production and inferred production using the pump as a meter. But when any of the basic assumptions above are not correct, the accuracy of the IP method decreases. The prior art "k" factor is $$k = \frac{R_t}{R_{IP}} \tag{4}$$

in which $R_t$ is the daily production rate measured in a traditional well test and $R_{IP}$ is the unadjusted inferred daily liquid rate. The k factor is multiplied by the unadjusted inferred daily liquid rate (determined from eq. 3a) to estimate the actual daily liquid rate of the well without actually measuring it by a traditional well test. The formula is, $$R_t = k\, R_{IP}, \tag{5}$$

where $R_t$ is the adjusted value that is taken to be equivalent to the traditional well test. Ideally, the k factor is just below 1.0, for example in the range of 0.85 to 0.9. This factor accounts for the fact that the fundamental assumptions above are not always correct. All pumps leak, at least slightly. Tubing is not always anchored at or near the pump.

A small volume of free gas is often present in the pump at the instant of traveling valve opening. If pressure in the pump is relatively high (the well is not completely pumped-off), the volume of free gas in the pump may not be small at all. Finally, most oil shrinks as gas evolves from it while passing up the tubing to the stock tank. Ideally the combined effect of these departures from the assumptions is small such that the k factor is slightly less than one as mentioned above.

The prior art method of using the subsurface pump as a meter for liquid volume inferred production (IP) is illustrated in the examples below.

EXAMPLE 1

A 1.5 inch subsurface pump is being used to infer production with typical full fillage and fluid pound pump cards shown in FIGS. 3E and 3F.

Determine:

(1) The incremental volume of liquid handled by the pump on the complete liquid fillage stroke of FIG. 3E, and (2) The incremental volume of liquid handled by the pump on the fluid pound stroke of FIG. 3F.

Solution:

(1) From FIG. 3E, the net liquid stroke $S_n$ is 117.5 inches (full liquid fillage). From eq. 2, $$\Delta V_l = \frac{\pi}{4}(1.5)^2(117.5) = 207.64 \text{ in}^3.$$

(2) From FIG. 3F, the net liquid stroke is 46.77 inches (incomplete fillage). From eq. 2

$$\Delta V_l = \frac{\pi}{4}(1.5)^2(46.77) = 82.65 \text{ in}^3.$$

Equation 3a is used with the $\Delta V_l$ values so calculated to infer liquid production.

EXAMPLE 2

A rod pumping well 10 is being monitored with a pump card WM 52. Unadjusted inferred production is 289 BFPD. A traditional well test during the same period is 263 BFPD. A month later, a larger unadjusted inferred production of 310 BFPD is noticed. The well is in a water flood.

Determine:

(1) The k factor.

(2) The inferred production rate one month later.

(3) The possible causes for the production increase.

Solution:

(1) The k factor is $$k = \frac{263}{289} = 0.91 \text{ (see eq.4)}$$

(2) Inferred production one month later is, $$R_t = k\, R_{IP} = 0.91(310) = 282\ BFPD \qquad \text{(see eq. 5)}$$

(3) Since the well is in a water flood, possible causes for the production increase are (a) further response to secondary recovery efforts, and (b) effect of a rod part in an offset producer and the attendant down time of that well.

The k factor is a useful but imperfect concept. One disadvantage is that it is not constant. For example, as the subsurface pump wears, the k factor decreases. Indeed if any of the quantities assumed to be negligible change, the k factor changes. Most significant of all, it would not be possible to compute the k factor if the traditional well test were to be entirely eliminated in favor of Inferred Production methods (see eq. 5 again).

3. Identification of Objects of the Invention

A primary object of this invention is to use a Well Manager in combination with a rod pumping unit to infer liquid production and gas production of a well with high accuracy.

Another object of the invention is to entirely eliminate traditional well tests for a rod pumped well by inferring liquid and gas production with high accuracy with a Well Manager Unit in combination with a rod pumping unit.

Another object of the invention is to remove limiting assumptions of negligible pump leakage, anchored tubing, negligible free gas and negligible oil shrinkage effects from prior art methods of inferring production when using a well manager with a rod pumping unit.

Another object of the invention is to provide inferred production methods that do not have timing and administrative problems inherent with traditional well testing.

SUMMARY OF THE INVENTION

The objects identified above along with other advantages and features are provided by a method and system in which pump leakage determinations are incorporated in the Well Manager, unanchored tubing determinations are incorporated in the Well Manager, and free gas remaining in the pump at TV opening are measured for each pump cycle. Furthermore, a method for inferring the rate of free gas production through the tubing is provided. Such measurements are incorporated in Inferred Production determinations such that accuracy is achieved which makes traditional well testing of the well unnecessary.

DESCRIPTION OF PREFERRED EMBODIMENTS OF THE INVENTION

As was discussed above, the prior art includes a method for inferring the liquid volume (oil and water) passing through the pump. Refer to equations (2) and (3a) above.

Inferred Measurement of Gas Production

Figure 3A:
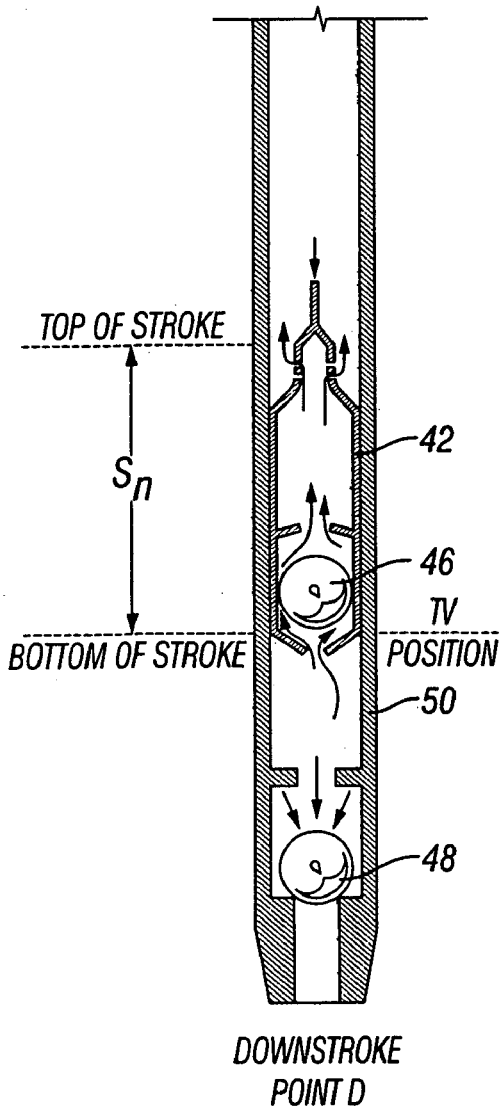
FIGS. 3A, 3B, 3C, and 3D illustrate operational conditions of a prior art reciprocating pump in conjunction with FIG. 3E which shows a typical down hole pump card where liquid in the well completely fills the pump on the up stroke and with FIG. 3F which shows a typical down hole pump card where liquid in the well only partially fills the pump on the up stroke.
Figure 3B:
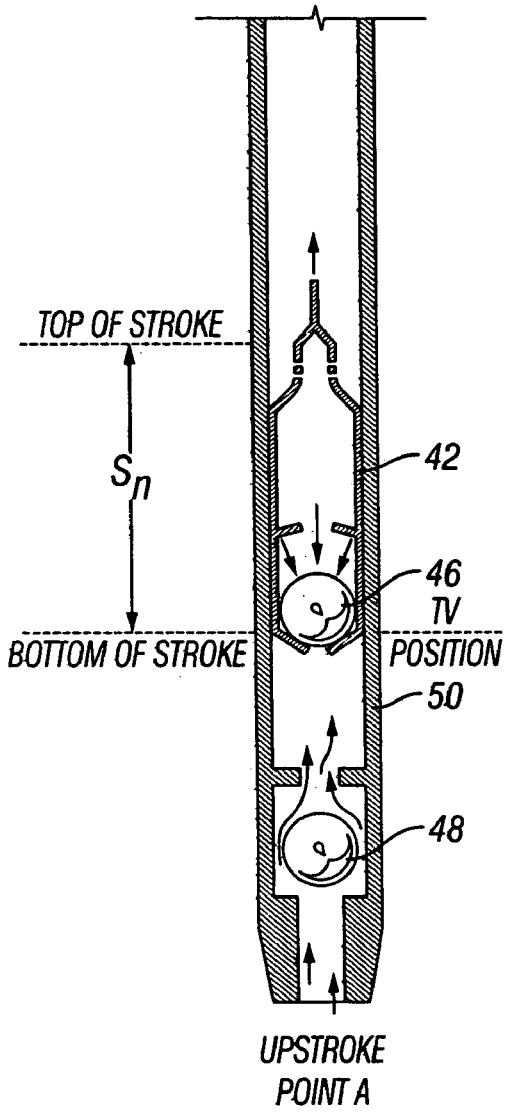
Figure 3C:
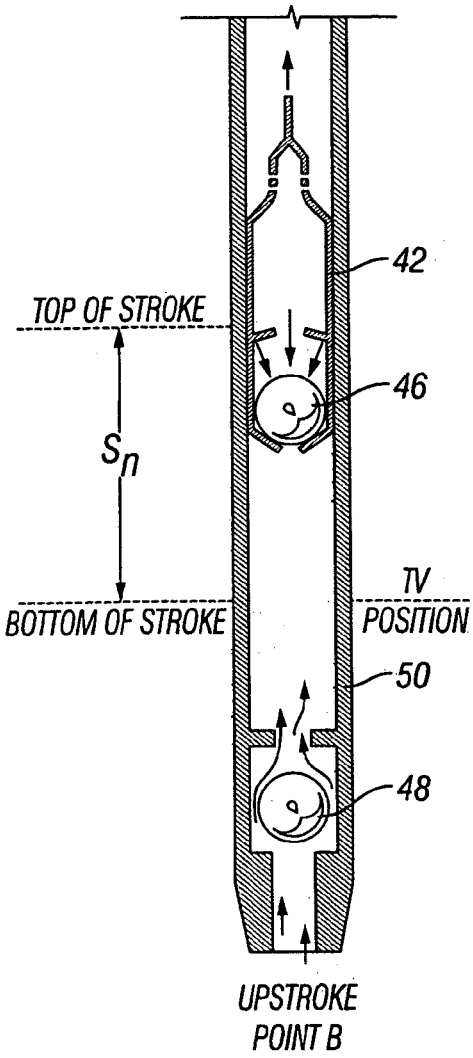
Figure 3D:
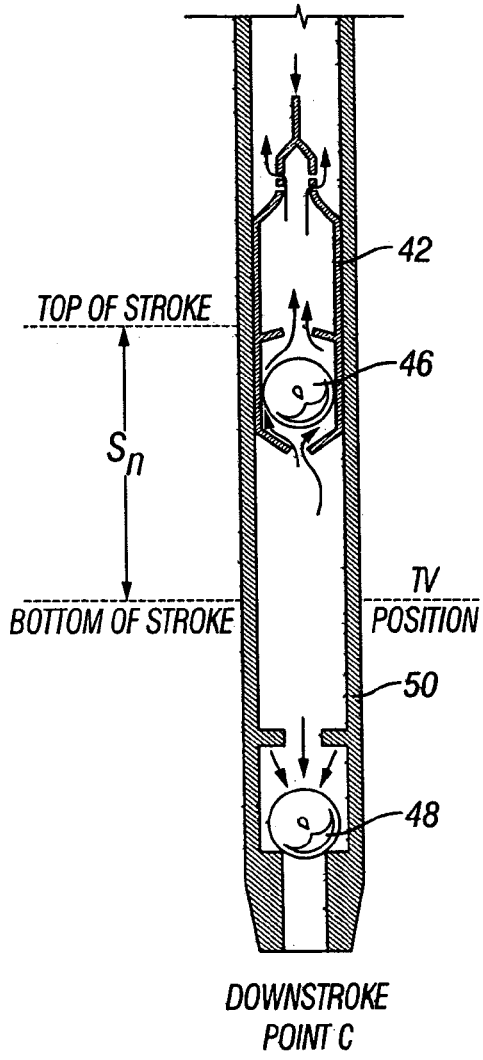
Figure 3E:
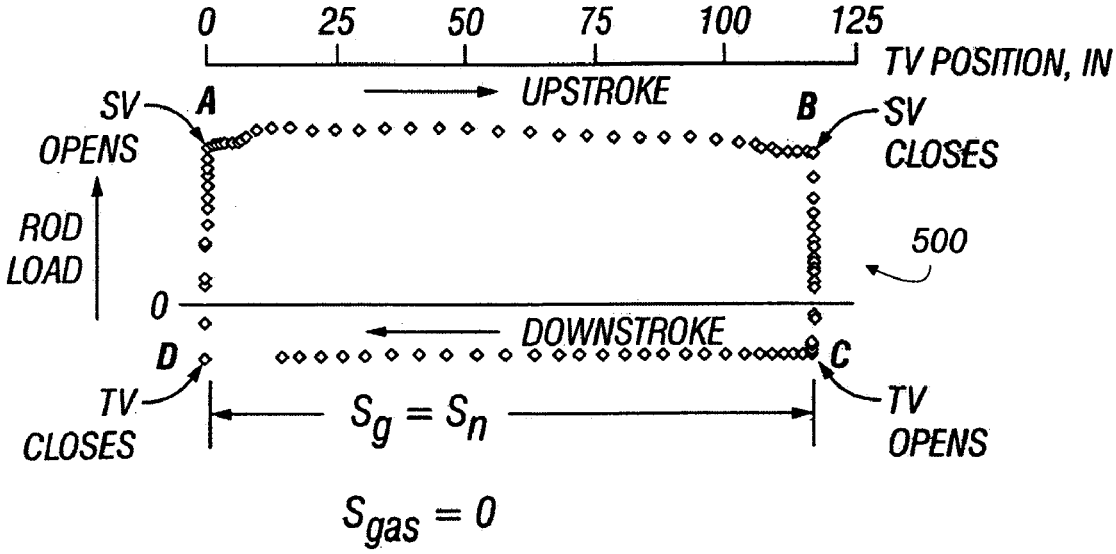
FIG. 3E (Prior Art)
Figure 3F:
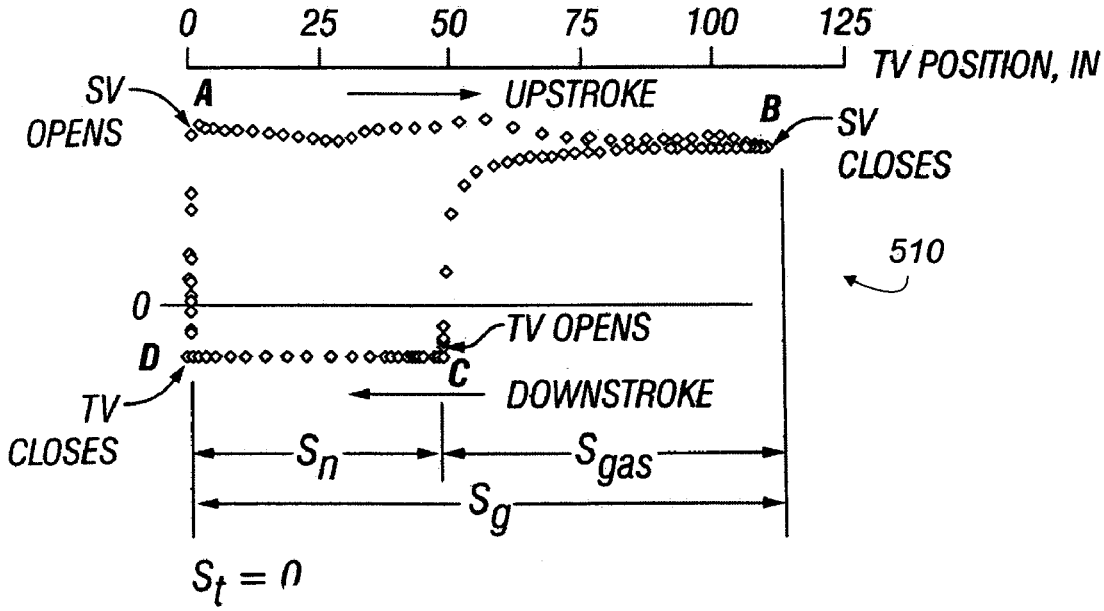
FIG. 3F (Prior Art)

One aspect of this invention concerns a method for measuring gas production. See FIG. 3F for an example of a well in which the pump is not completely filled with liquid on the pump downstroke.

The volume of gas passing through the pump on the stroke in question 220 is $$\Delta V_g = \frac{\pi}{4} d^2 (S_g - S_n) = \frac{\pi}{4} d^2 S_{gas} \tag{6}$$

Gas volume, like liquid volume (equation 2 of the prior art method), is also measured in cubic inches. To obtain gas volume in standard cubic feet, gas pressure and temperature must be known. Similarly when the WM 52 has the unit 10 turned off, $$\Delta V_g = 0.$$

Similar to the derivation of inferred liquid production of the prior art of equation (3a), a method 200 has been developed for inferring the daily rate of free gas production, $G_{IP}$, (SCF/day) through the tubing, $$G_{IP} = \frac{50}{T_d + T_p}\left(\frac{P_i}{P_x}\right)\left(\frac{z_s}{z_i}\right)\left(\frac{T_s}{T_i}\right)\sum \Delta V_g \tag{3b}$$

where $P_s$, $z_s$, and $T_s$ are standard pressure (14.65 psia), gas compressibility factor at standard pressure, and standard temperature of 520 deg R, respectively. The same quantities subscripted i are evaluated at pump intake pressure and pump temperature. The factor 50 converts cubic inches per second into cubic feet per day.

Improvements in Inferred Production

This invention also concerns improvements in the methods and apparatus described above by which a Well Manager (WM) in combination with a rod pumping unit infers production from a well. The improvements allow for determination of Inferred Production of the well by eliminating assumptions of the prior art technique, thereby allowing measurement of the production with information from the down hole pump and obviating the need for periodic traditional well testing.

The description of the invention presented below uses relationships measured in common English measurements such as inches, cubic inches, barrels, etc. The invention can be used with measurements expressed in other measurement systems such as the metric system. The use of the English measurement system is not intended to limit the invention, but merely to show units consistency among the variables presented.

Elimination of Assumption of Negligible Pump Leakage

The first improvement concerns adding a method 202 which can be practiced by software in the WM by which the assumption of negligible pump leakage is eliminated. In other words, existing WM determination of inferred production of a rod pumped well, liquid production according to equations 3a and a new determination of gas determination according to equation 3b described above, are automatically augmented with techniques of the August 1990 SPE Production Engineer publication described above.

TV Pump leakage from Down Hole Pump Dynamometer Card and Pump Velocity: "Pump Card" Method This method uses the pump card and pump velocity to determine the critical point at which upward displacement rate equals, leakage rate. The method applies when the pump card shape shows abnormal pump leakage.

Figure 4:
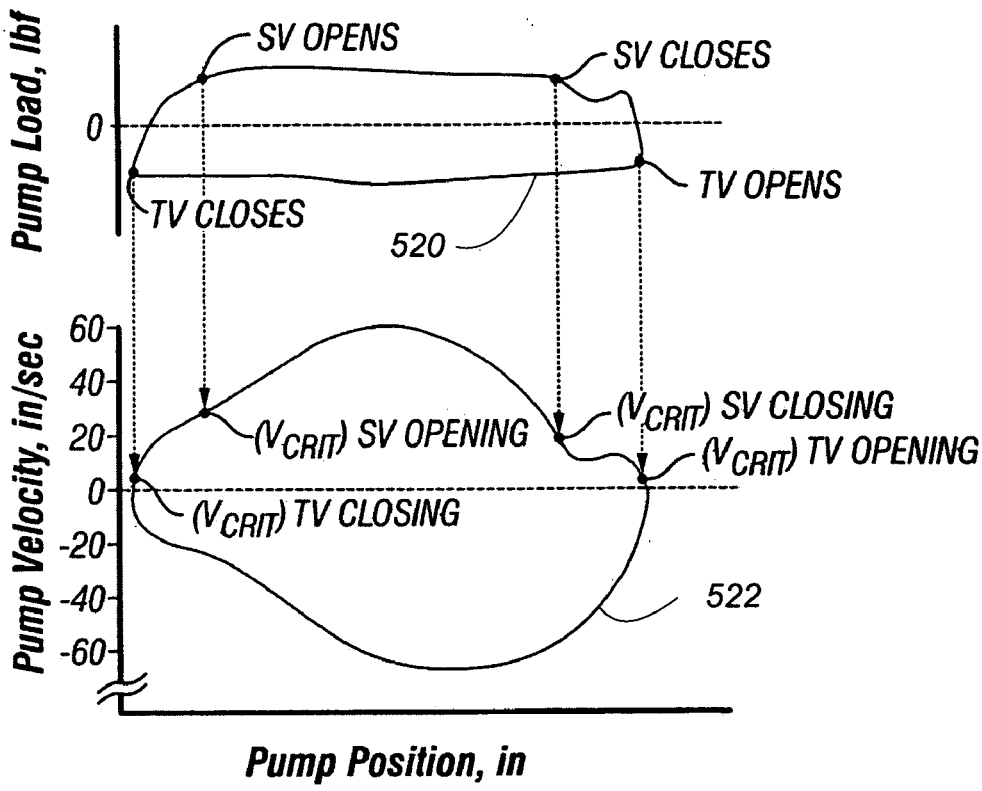
FIG. 4 shows a down hole card and an aligned pump velocity versus pump position graph which illustrates a method for determining valve leakage of a down hole reciprocating pump as in FIGS. 1–3.

When a severe traveling valve (or plunger) leak exists, the characteristic pump card shows a delayed load pickup and a premature load release. The standing valve opens when the upward lifting rate (measured in BPD) begins to exceed the downward slippage rate (BPD). The lifting rate depends on pump diameter and pump velocity. Pump velocity is derived from the pump card by numerical differentiation. The formula for TV/plunger slippage rate is $$L_{TV} = 6.99\ d^2 C_p V_{crit} \tag{7}$$

in which $C_p$ is a coefficient derived from the pump card, $V_{crit}$ is the critical pump velocity (in/sec) at standing valve opening ($C_p$ is sometimes taken to be 0.5), and d is the pump diameter (inches). See Appendix A for a derivation of $C_p$ 402. Pump diameter is the only additional parameter needed over and above those already required for computing the pump card. The pump card method for evaluating pump leakage works best for severely worn pumps. For the example pump card 520 and pump velocity versus pump position plot 522 shown in FIG. 4, for a 1.25 in. pump (and $C_p$=0.47 derived from the pump card) $L_{TV}$=6.99 $(1.25)^2$ (0.47) (26.6)=137 B/D. Analogous methods for sensing standing valve leakage using the pump card are also available.

The computer program in WM is written to estimate the point of standing valve opening and closing and traveling valve opening and closing 400. See FIGS. 3E and 3F for example pump cards 500, 510 where traveling and standing valves are in good working order. One way to determine the point on the pump card where standing valve opens is to determine that point from TV closure where the pump load rises to 90% of the fluid load. Another way is to look for a change in direction of the pump card trace when fluid load pickup transitions to fluid lifting. Thus, for the pump card method of automatically determining pump leakage of the rod pumping system 10 of FIG. 1, the following steps are performed, Referring to FIG. 4, 1) Determine $C_p$ 402 (i.e., estimate $C_p \cong 0.5$, or measure $C_p$ according to method of Appendix A).
2) Determine 404 a pump velocity versus pump position relationship 522 from the pump card 520 being generated periodically in the WM.
4) Determine critical pump velocity $V_{crit}$ relative to standing valve status
   a) determine $V_{crit}$ at SV opening 406
   b) determine $V_{crit}$ at SV closing 410
5) Determine Traveling Valve Leakage $L_{TV}$
   a) determine $L_{TV}$ at SV opening 408

$$L_{TV}=6.99d^2C_p\,(V_{crit})_{SV\ opening}$$

b) determine $L_{TV}$ at SV closing 412

$$L_{TV}=6.99d^2C_p\,(V_{crit})_{SV\ closing}$$

6) Chose $L_{TV}$ from 5 a) or from 5 b) or the average of $L_{TV}$ from 5 a) and 5 b) 414
7) Determine TV opening and TV closing points 400
8) Determine critical pump velocity $V_{crit}$, relative to Traveling Valve status
   a) determine $V_{crit}$ at TV opening 416
   b) determine $V_{crit}$ at TV closing 420
9) Determine Standing Valve Leakage $L_{SV}$
   a) $L_{SV}=6.99d^2(1-C_p)(V_{crit})_{TV\ opening}$ 418
   b) $L_{SV}=6.99d^2\,(1-C_p)(V_{crit})_{TV\ closing}$ 422
10) Chose $L_{SV}$ from either 9a) or 9b) or the average of $L_{SV}$ from 9a) and 9b) 424

TV Pump Leakage From Surface Rod Load and Position Time Histories ("Rolling Stop" Method)

Figure 5:
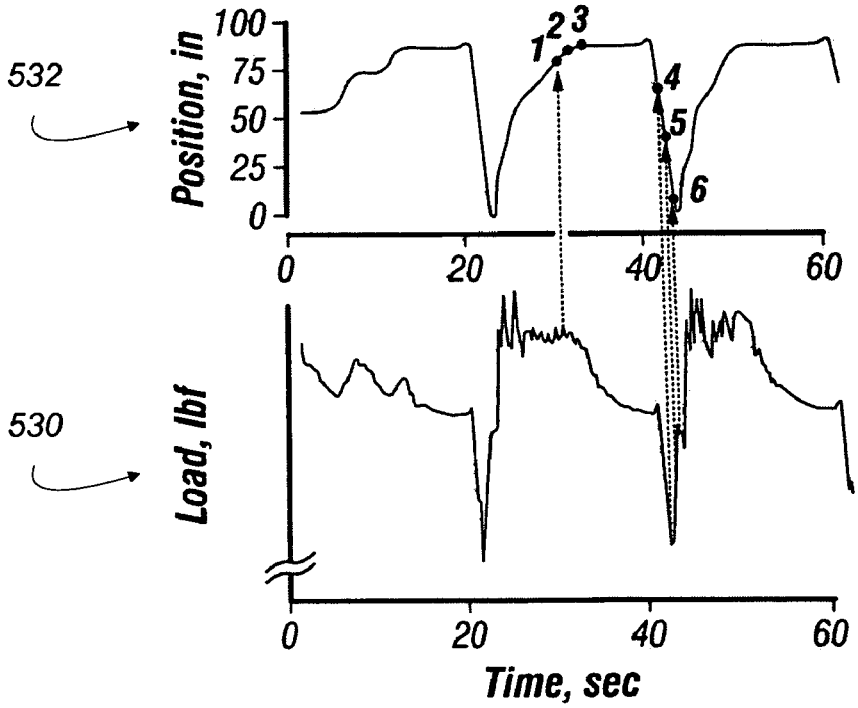
FIG. 5 shows aligned graphs of surface rod position and load versus time for the rod pumping unit of FIG. 1 which illustrates another method for determining valve leakage of a down hole reciprocating pump as in FIGS. 1–3.

Another method for sensing pump leakage is shown in FIG. 5 which involves analyzing 426 surface rod load and position time histories 530, 532. This method works best for shallow wells with small to severe pump leakage rates. In shallow wells, the pump card looks much like the surface dynamometer card. Further, the critical pump velocity $V_{crit}$ is closely approximated by the critical velocity shown at the surface. This is called the "rolling stop" method and uses the same concept as the pump card method described above. The only difference is that the pump card method involves an increase in pump velocity whereas the method of FIG. 5 observes the rod string slowing down. When rods slow down, the surface load begins to decrease when the load begins to be transferred from the traveling valve to the standing valve. Lifting rate (BPD) is again equal to downward slippage rate (BPD). The points 1, 2 and 3 in FIG. 5 are used to compute the critical velocity (by differentiation) needed in eq. 7. An analogous procedure is available for sensing standing valve leakage. For an Inferred Production program in WM, the points 1, 2 and 3 are determined, a curve is found through them and critical velocity is determined by differentiating the position versus time relation for such curve.

Referring to FIG. 5,

1) Determine a curve through points 1, 2 and 3 where the rod-pumping unit is rising and the unit's upward velocity is maintaining polished rod load fairly constant. Identify point 1 where a small decrease in upward velocity causes the polished-rod load to decrease signifying the time at which upward velocity is no longer sufficient to keep the standing valve open, and determine $V_{crit}$ on SV closing (for TV leakage) 428.
2) Determine $V_{crit}$ 428 at point 1 by differentiating a curve which passes through points 1, 2, 3,
3) Compute TV leakage 412 from $$L_{TV}=6.99d^2C_p(V_{crit})\ \text{point } \mathbf{1}$$

An analogous procedure can be used for SV leakage. While the unit is moving downward, find points 4, 5, 6 such that at point 4 the downward velocity is no longer adequate to keep the TV open 430. At this point, surface load beings to increase.

4) Compute SV leakage 422 from $$L_{SV}=6.99d^2(1-C_p)(V_{crit})\ \text{point } \mathbf{4}$$

In deep wells pump velocity is no longer approximately equal to surface velocity. This results from greater rod stretch and time lag of traveling waves which are significant in deep wells. An analogous method uses pump velocity and load (instead of surface velocity and load) can be derived from the wave equation.

Deriving TV/Plunger Leakage from Traveling Valve Load Loss Rate

Figure 6:
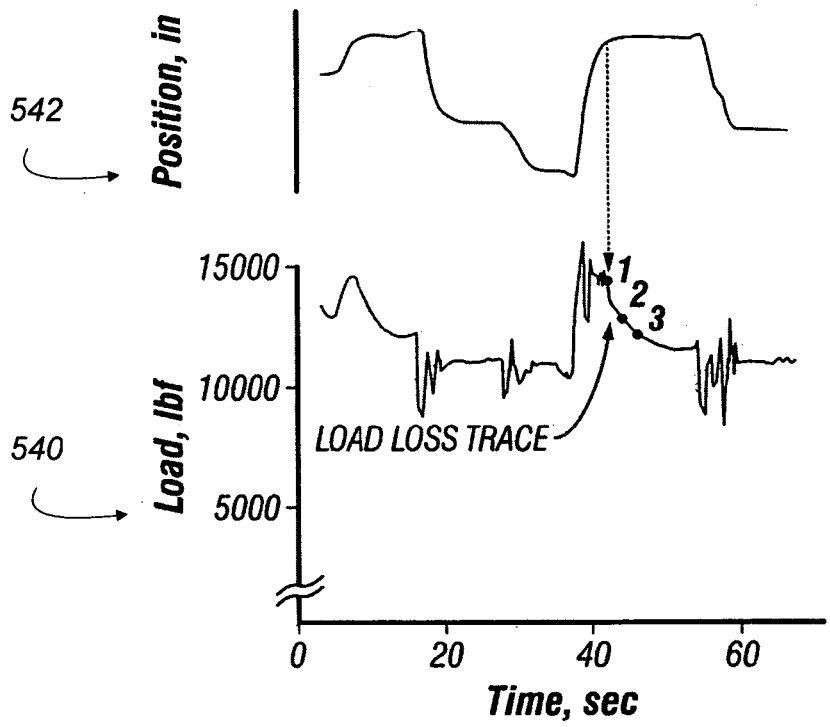
FIG. 6 shows aligned graphs of surface rod position and load versus time for the rod pumping unit of FIG. 1 which illustrates yet another method for determining valve leakage of a down hole reciprocating pump as in FIGS. 1–3.

Another quantitative method for deriving pump leakage is shown using surface rod load and position time histories 540, 542 of FIG. 6. This senses TV/plunger leakage by recognizing that the rods contract as fluid slips by the TV/plunger assembly causing the load to be transferred from the traveling valve to the standing valve. The volume of slippage during this time is the product of the pump area and the rod contraction distance. The rate of load loss is related to leakage 434 by means of the equation, $$L_{TV} = 6.99\,d^2C_pk_{rt}\left(\frac{dF}{dt}\right)_{\max} \tag{8}$$

where, $L_{TV}$ = leakage rate of the *TV*/plunger assembly in *BPD*

$k_{rt}$ = the combined stretched constant for the rod string and unanchored tubing (in/lb)

$\left(\frac{dF}{dt}\right)_{\max}$ = the maximum rate of traveling load loss (lb/sec).

The maximum load loss rate occurs at point 1 in FIG. 6 and is evaluated 432 by differentiating a second degree polynomial passed through points 1, 2 and 3. This method works in all cases as long as the load loss trace is not nearly vertical. In such cases, the "rolling stop" method of FIG. 5 is preferable. An analogous method 436 is available for sensing standing valve leakage from maximum load increase rate.

For automatic application of the maximum load loss rate method of FIG. 6, the load loss trace for load versus time 530 is determined, a polynomial is passed through points 1, 2 and 3, and $F_t$ as a function of time is determined. The derivative is determined from that curve and a $$\left(\frac{dF}{dt}\right)_{\max}$$

is found for application in equation 8.

Adjusting for Pump Leakage Based on Time on

Automatic sensing of pump leakage is a great improvement to the methods of the prior WM. The equation, $$\text{stroke distance} = \frac{bpd}{0.1166(d^2)(SPM)}$$

where stroke distance denotes the equivalent pump stroke proportional to pump leakage, for example d denotes the diameter of the pump in inches SPM denotes the pump speed of the surface unit, strokes per minute bpd denotes the volume of production corresponding to stroke distance, for example, lost by pump leakage, barrels per day, (See also Appendix B, infra), is used to compute the effective stroke lost to pump leakage, $S_{leak}$ 216. Such pump leakage must be adjusted in accordance with on-time percentage, because the TV/plunger only leaks when the pump is running. The increment of liquid production on a given stroke is computed from, $$\Delta V_{net} = \frac{\pi}{4} d^2 (S_l - \%_{on} S_{leak})$$

where $$\%_{on} = \frac{T_P}{T_P + T_d}$$

and $S_{leak}$ is based on the full daily leakage in bpd.

Eliminating the Assumption of Anchored Tubing

Figure 1:
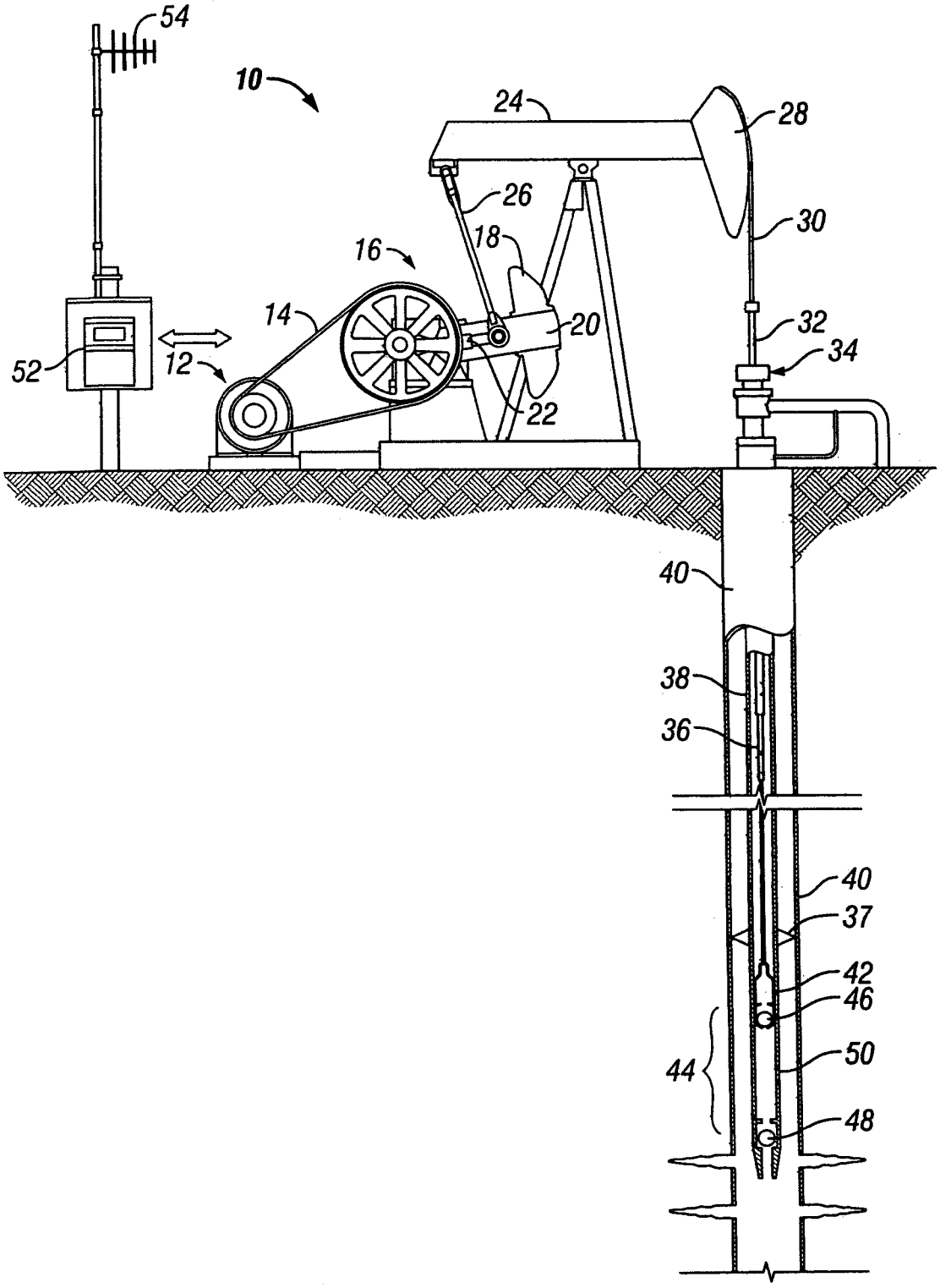
FIG. 1 (Prior Art)
FIG. 1 is a schematic illustration of a prior art rod pumping unit for a well with a reciprocating pump and with a Well Manager Unit for controlling operation of the rod pumping unit.
Figure 2A:
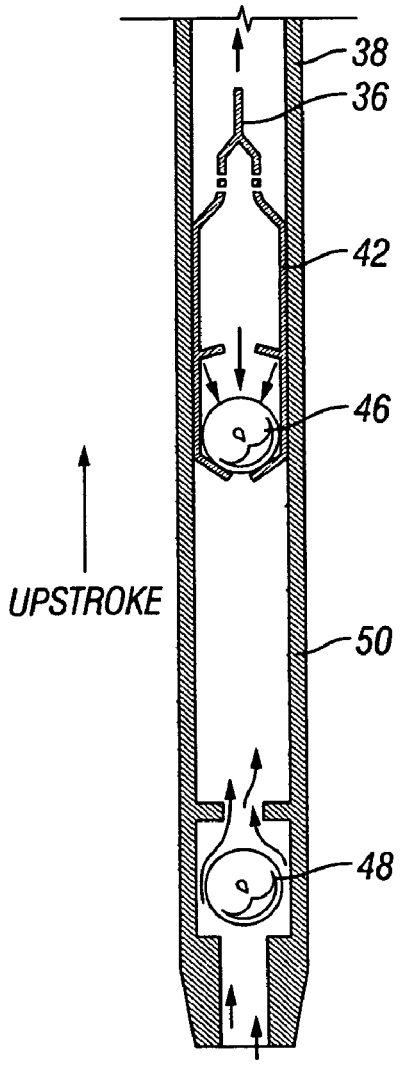
FIG. 2A (Prior Art)
FIGS. 2A and 2B are schematic illustrations of a prior art reciprocating pump showing operation of a standing valve and a traveling valve during upstroke and down stroke operation of the pump.
Figure 2B:
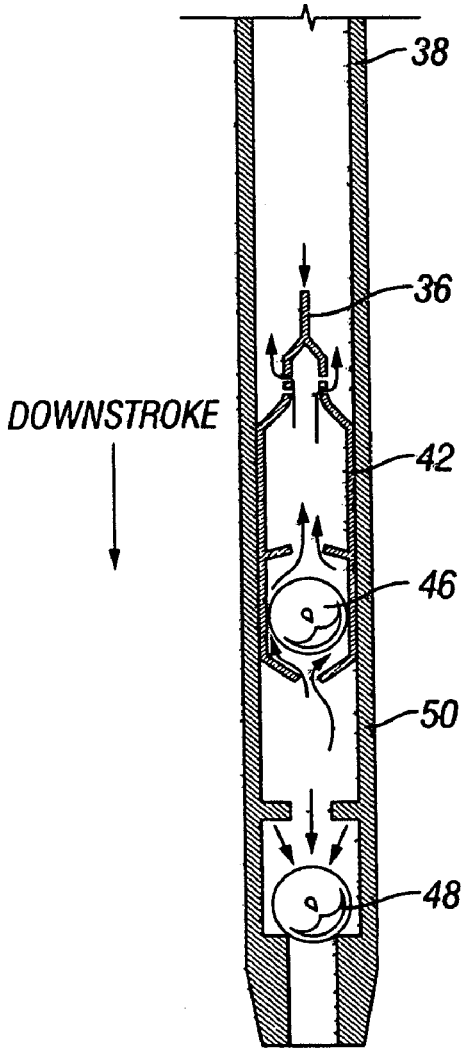
FIG. 2B (Prior Art)

As illustrated in FIG. 1, the tubing 38 can be fixed to casing 40 by a tubing anchor 37. Tubing is anchored primarily for three reasons: (1) to prevent tubing movement thereby increasing net liquid stroke, (2) to prevent relative motion between casing and tubing and the tubular wear that it causes, and (3) to prevent the tubing from parting due to cyclic load fatigue failure. Tubing is anchored in most wells when pumps are set at 2000 ft or deeper. Sometimes tubing anchors fail to hold. Thus, it is not sufficient to assume that the tubing is not moving just because the records say that a tubing anchor is installed. The pump card must be examined to make sure.

FIG. 7 illustrates the generation of a pump card 550 for a pumping unit where tubing is not anchored to the casing by means of an anchor 37 shown in FIG. 1. As illustrated in FIGS. 7*a* and 7*b*, the pump 44 moves a distance $S_t$ between TV closing (FIG. 7*a*) and SV opening (FIG. 7*b*) when pump load is put on the plunger 42 and removed from the tubing 38. The pump 44 moves an equal and opposite distance $S_t$ between SV closing (FIG. 7*c*) and TV opening (FIG. 7*d*).

Figure 7A:
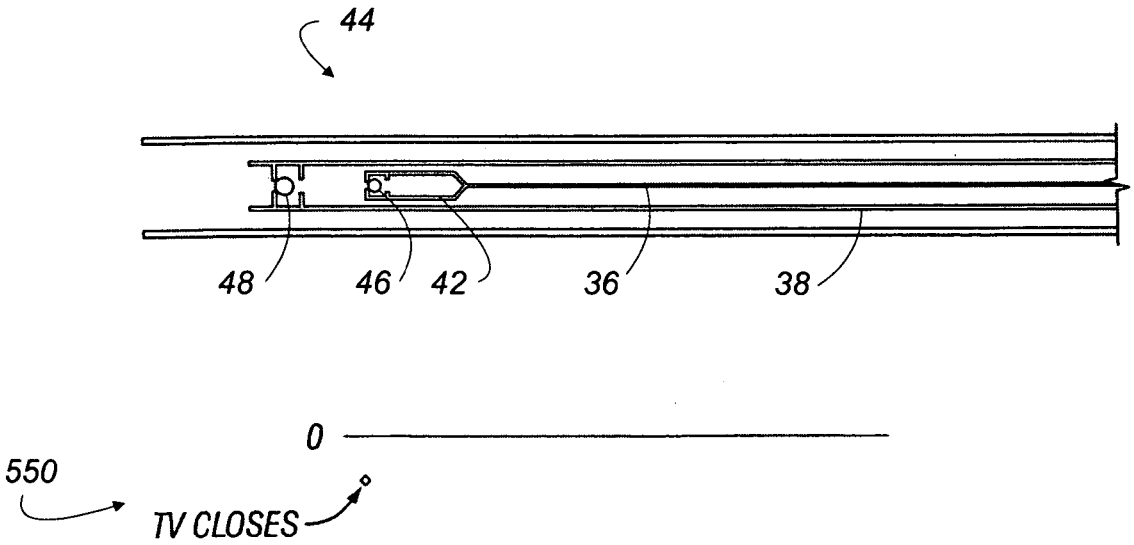
FIGS. 7A–7D illustrate a subsurface reciprocating pump in which tubing is not adequately anchored to the well casing, the Figures showing the shape of a down hole pump card by which tubing anchor inadequacy can be identified.
Figure 7B:
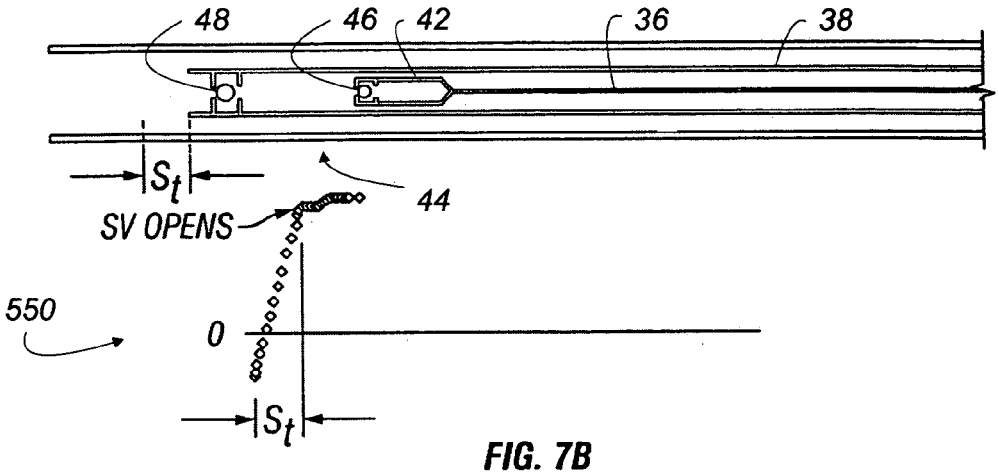
Figure 7C:
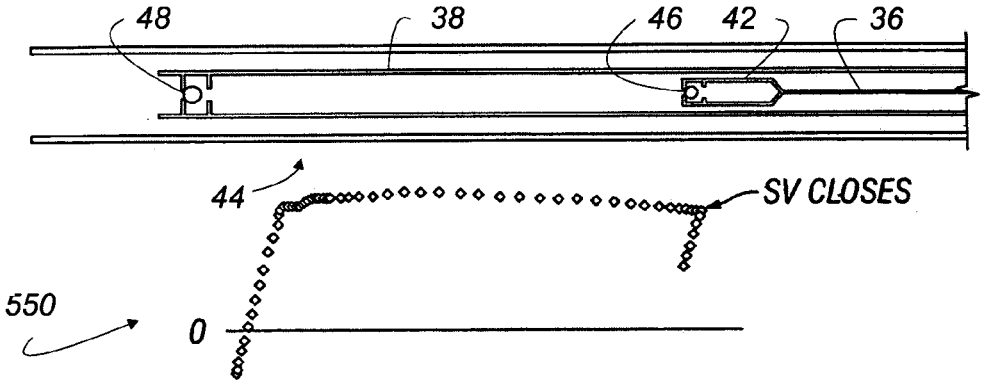
Figure 7D:
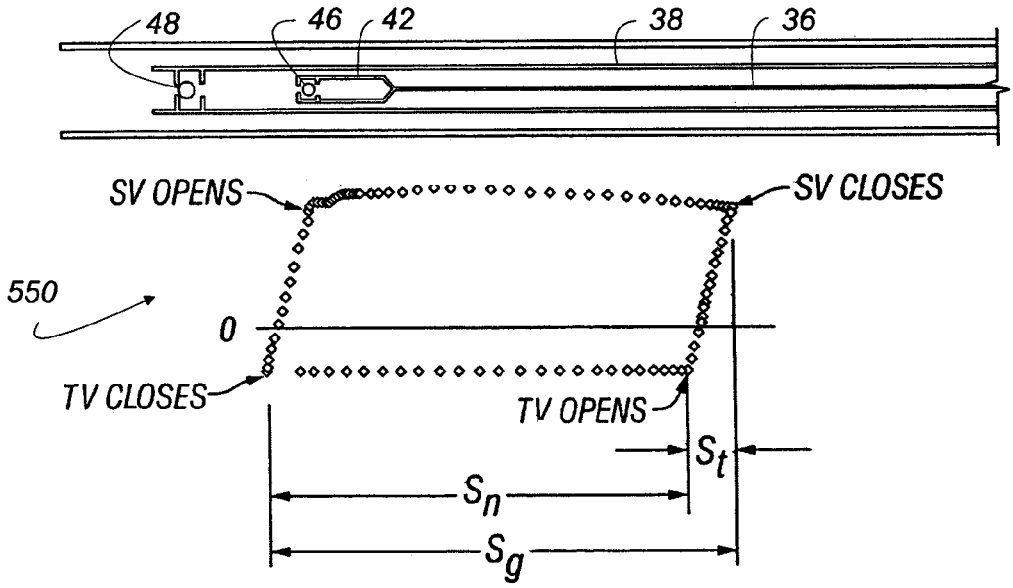

FIG. 7*d* shows a pump card 550 with full liquid fillage and unanchored tubing. The card 550 has a rhombus shape rather than a rectangular shape. According to the invention, tubing stretch $S_t$ is automatically determined so that a net liquid stroke $S_n$ can be determined 232. For full liquid fillage and unanchored tubing $S_n = S_g - S_t$ as FIG. 7*d* shows. As always TV opening is used to determine liquid stroke. Pump cards with incomplete fillage and unanchored tubing show the TV opening further to the left, i.e. the plunger has moved further into the down stroke than the distance $S_t$. The load trace between SV closing and TV opening also shows evidence of gas compression. In many cases the magnitude of the tubing stretch $S_t$ is closely approximated 204 by Hooke's law, statically applied, $$S_t \cong 12 \frac{L_f D_p}{E_t A_t} \tag{9}$$

where, $S_t$ is tubing stretch in inches, $L_f$ is the fluid load read from the pump card (lb), $D_p$ is the pump setting depth (ft), $E_t$ is the modulus of elasticity of the tubing (psi) and $A_t$ is the cross sectional area of the tubing ($in^2$). The factor 12 converts tubing stretch from feet to inches.

Eliminating the Assumptions of Free Gas and Oil Shrinkage

Figure 8A:
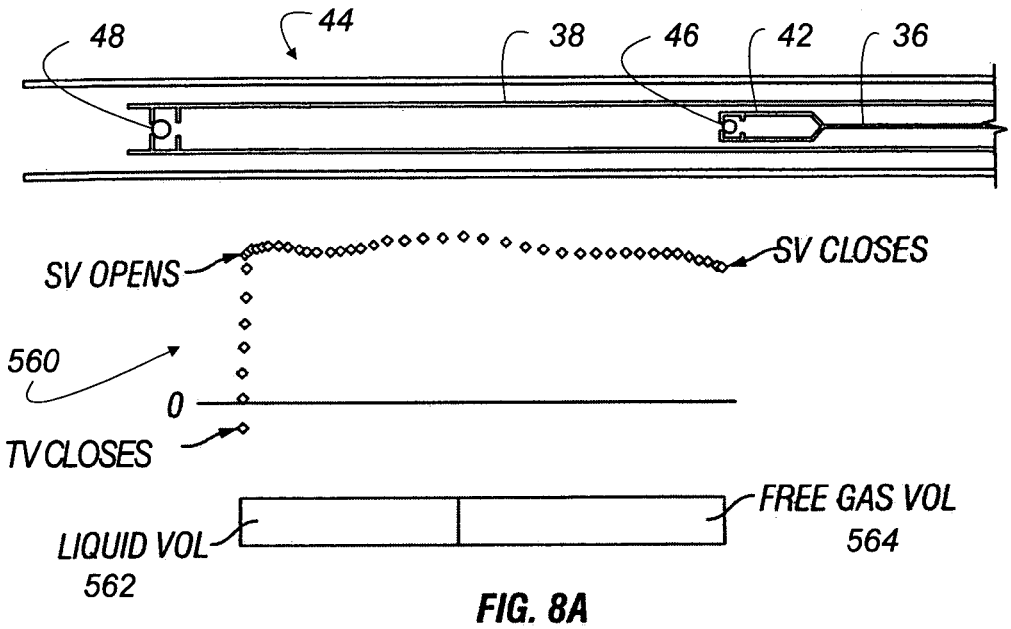
FIGS. 8A–8D illustrate a subsurface reciprocating pump which is not completely filled with liquid on the down stroke of the pump and for which gas in the pump is at high pressure.
Figure 8B:
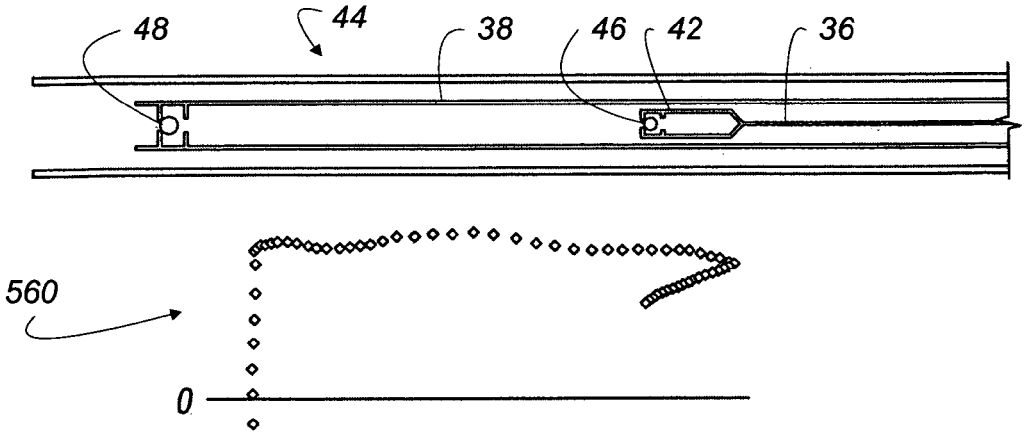
Figure 8C:
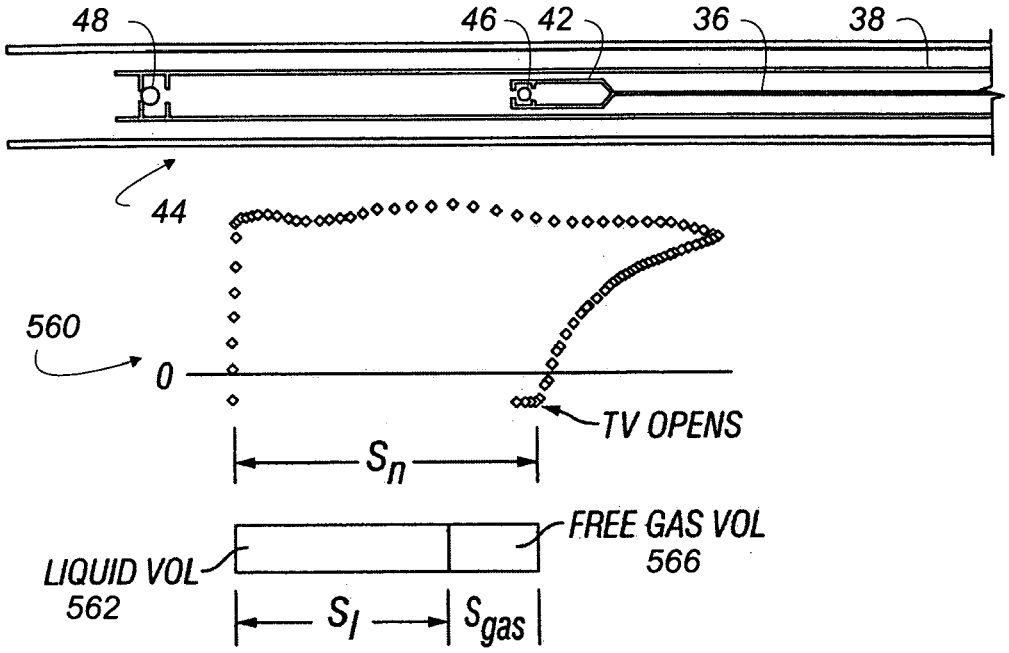
Figure 8D:
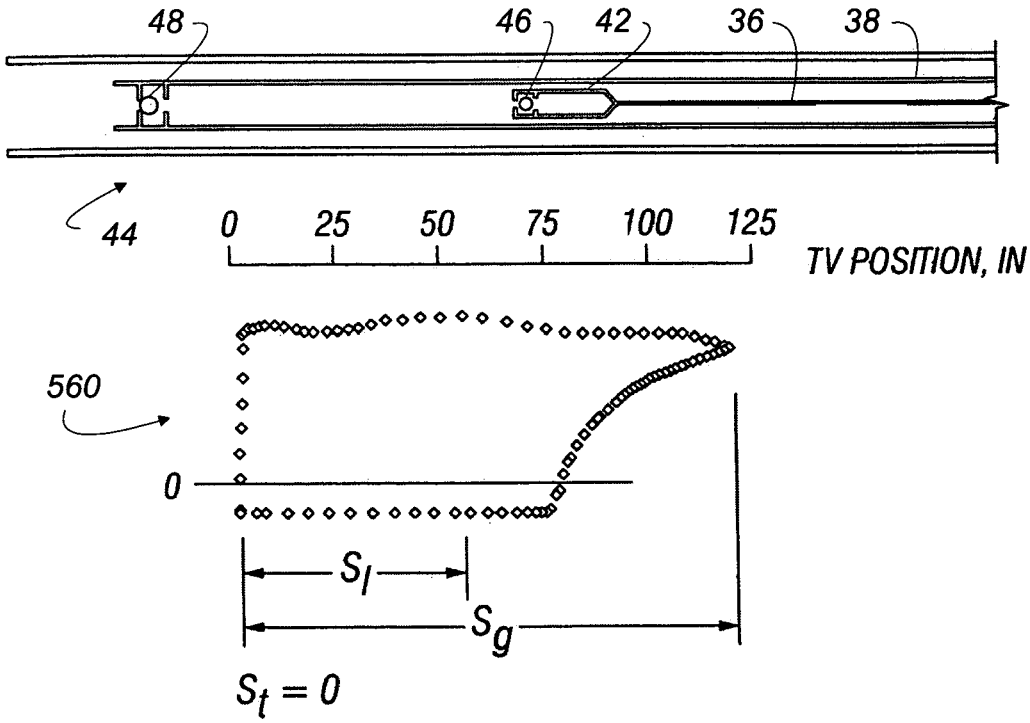

FIGS. 8A–8D show a pump card 560 being generated where free gas is in the pump at the time of TV opening. FIG. 8A shows the volume of the liquid 562 and free gas 564 in the incompletely filled pump 44. FIG. 8C shows that the volume of free gas after it is compressed is not necessarily small. The controlling factor is the pressure of the gas as it enters the pump (the pump intake pressure). As this pressure increases, the volume of the free gas at TV opening increases such that it may no longer be negligible. In this most general case, the formula for liquid stroke 224 is, $$S_t = S_n - S_{gas} \tag{10}$$

in which $S_t$ is the liquid stroke (in) and $S_{gas}$ is the stroke corresponding to the volume of free gas remaining in the pump at TV opening (Assumption 3). $S_n$ remains the distance traveled by the pump from TV opening to the bottom of the stroke 232. When $S_{gas}$ is negligibly small, the liquid stroke is simply $S_n$.

The prior art has obtained pump intake pressure 206 for many years in equipment as in FIG. 1 where a well manager is provided in conjunction with a rod-pumping unit 10. Pump-intake pressure is determined by the equation, $$P_i = P_a - \frac{L_f}{A_p} \tag{11}$$

where $P_i$ is the pump intake pressure (psi), $P_a$ is the pressure above the pump plunger caused by tubing head pressure and hydrostatic effects of oil-gas-water in the tubing (psi), $L_f$ is the fluid load which is derived from the pump card (lb) and confirmed with valve checks, and $A_p$ is the area of the plunger ($in^2$).

Figure 13:
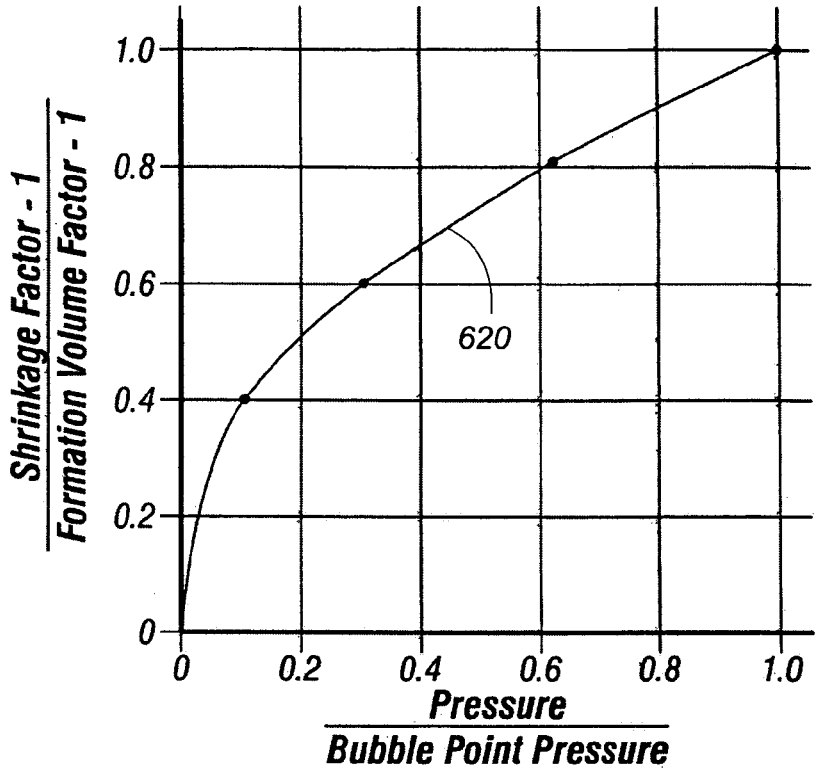
Figure 14:
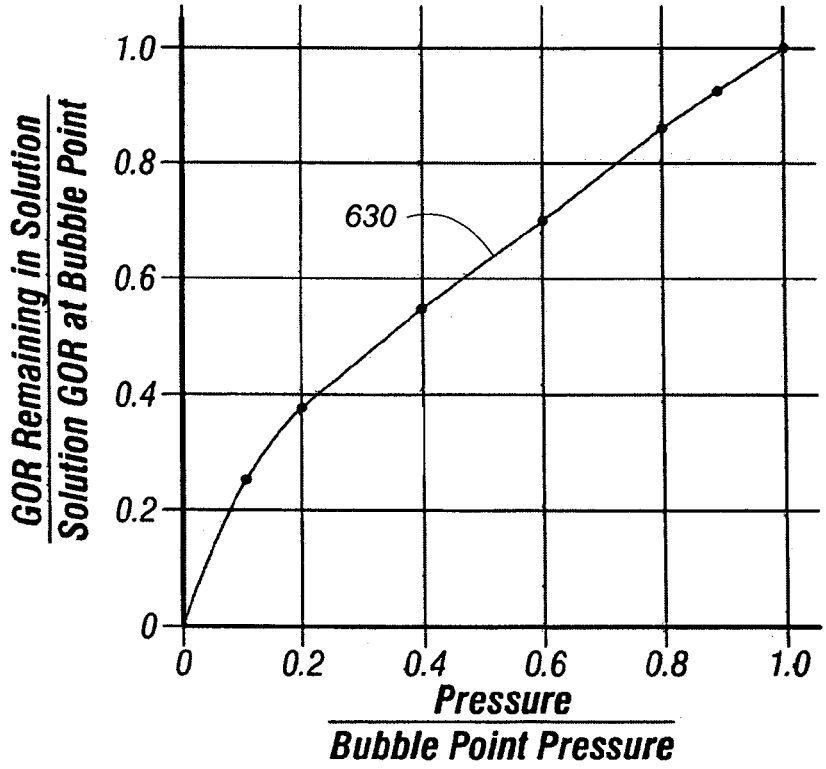
Figure 15:
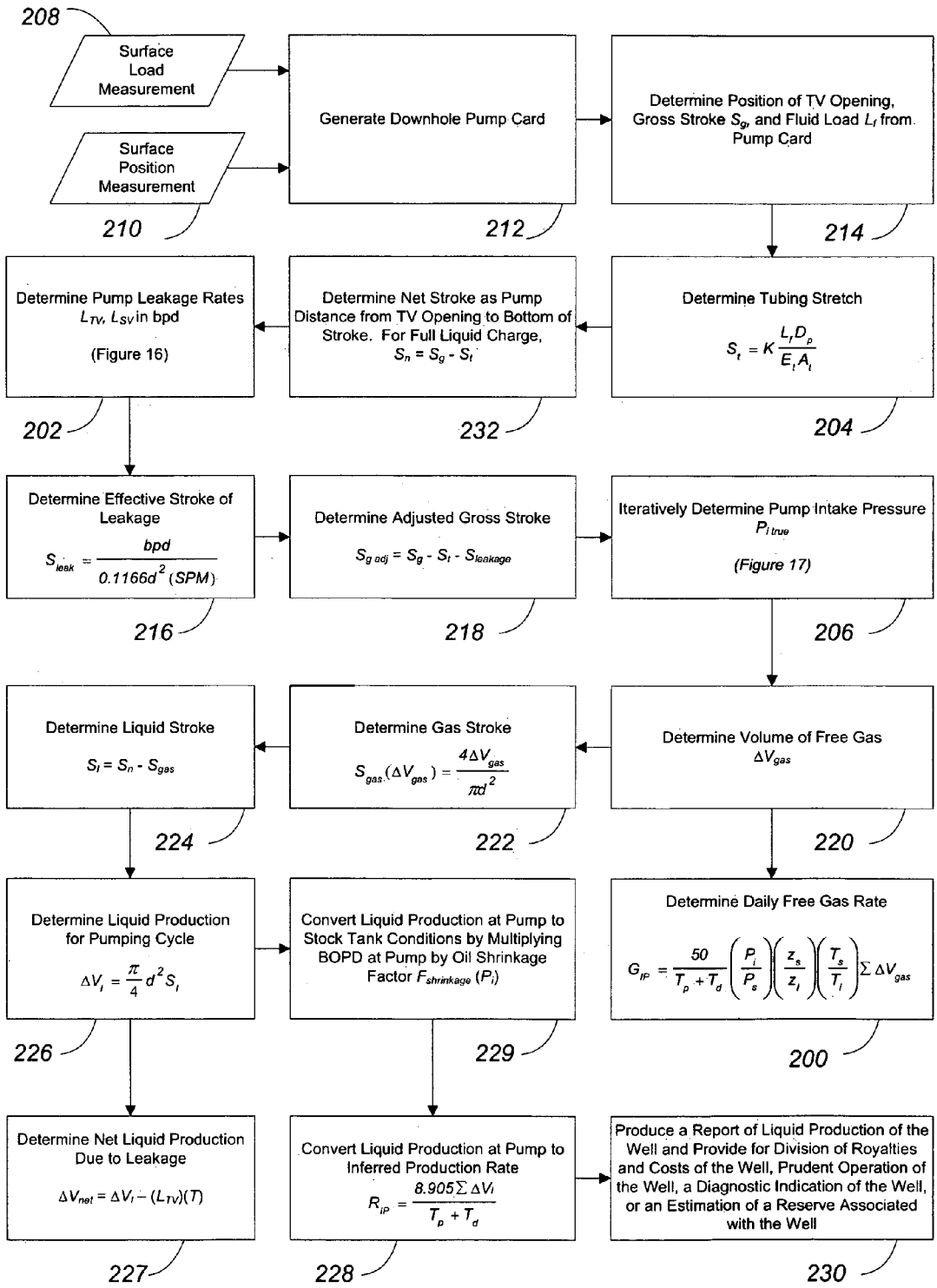
FIGS. 15, 16, and 17 illustrate flow chart schematic diagrams according to one or more methods of the invention.
Figure 16:
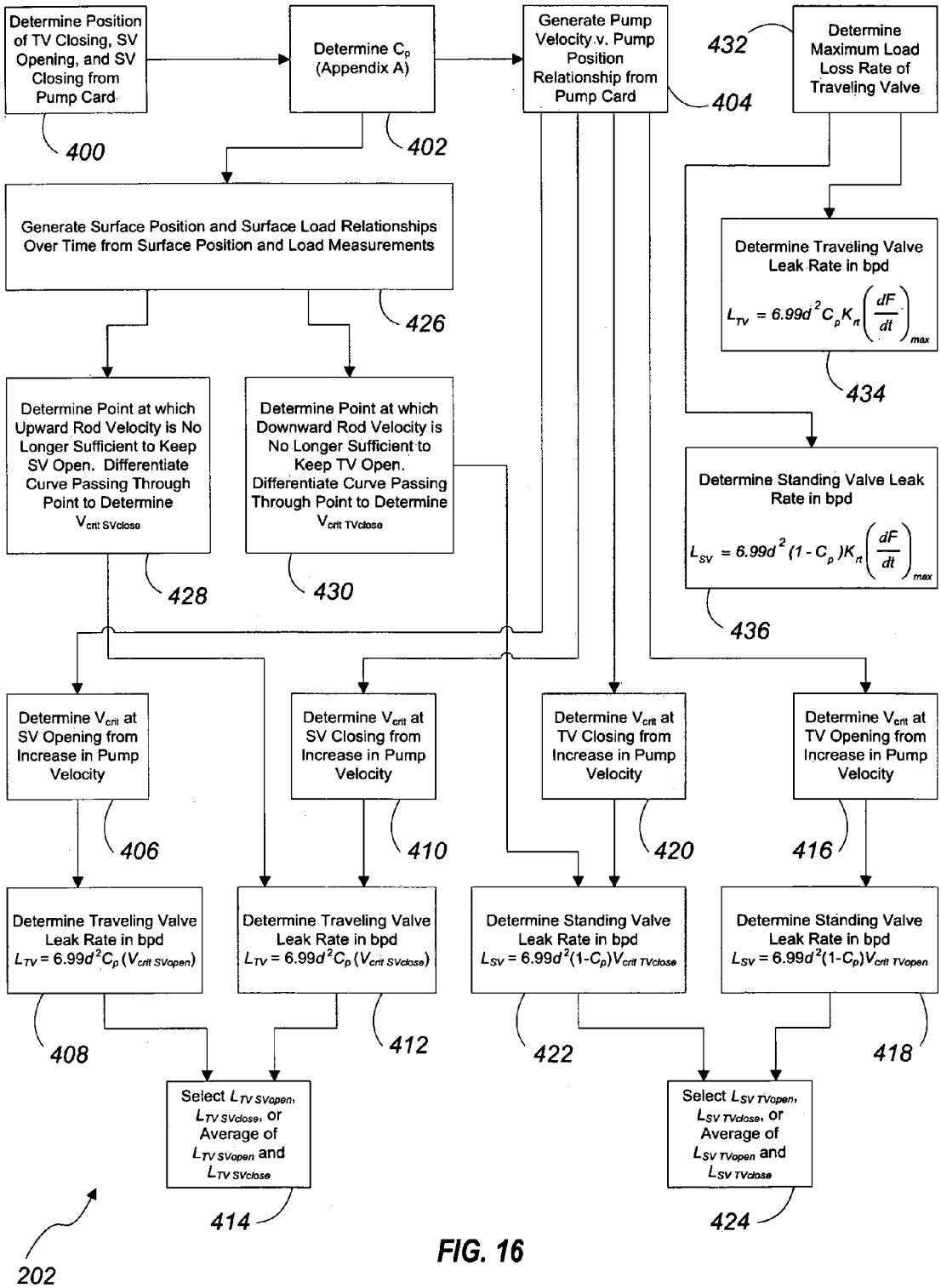
Figure 17:
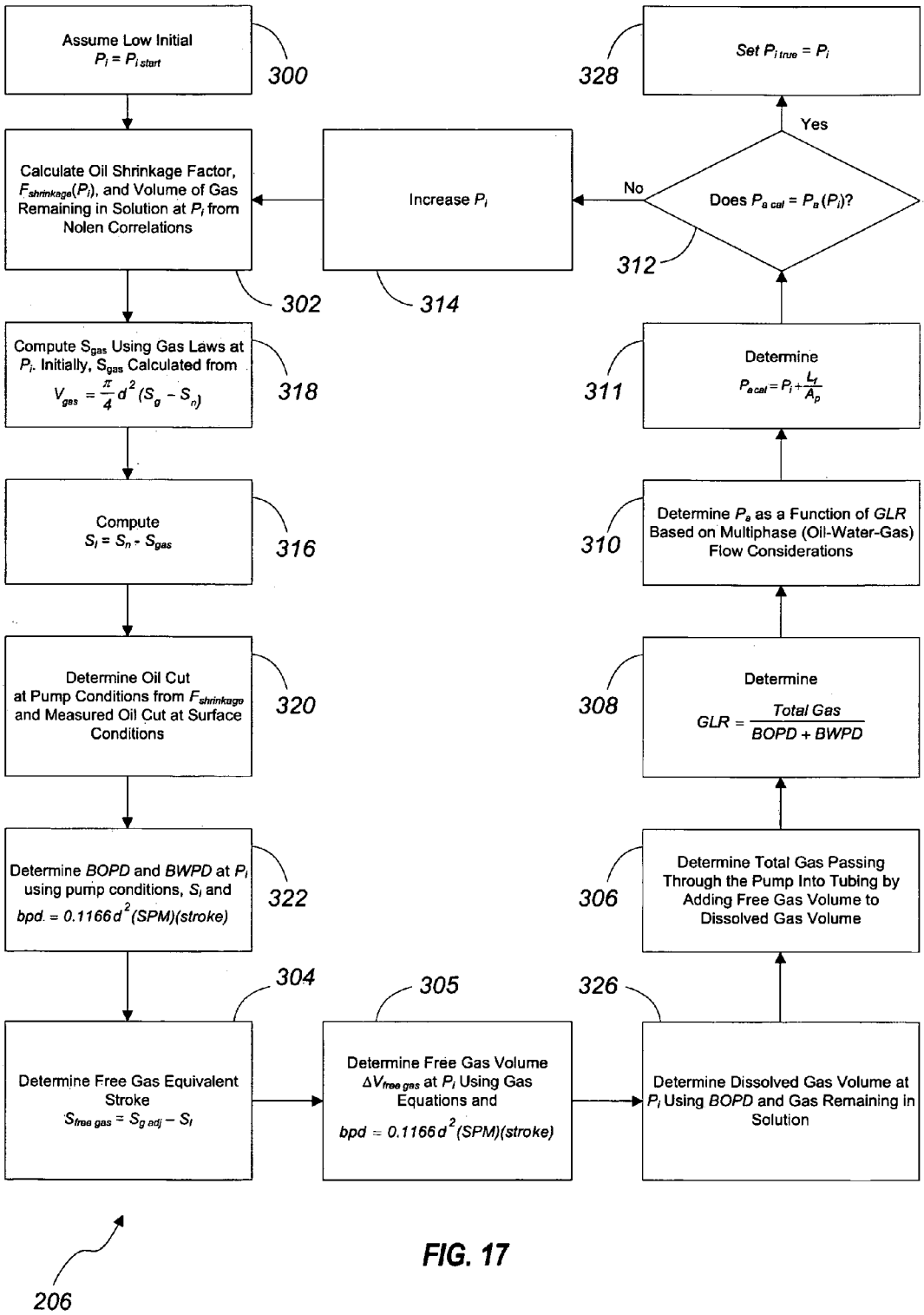

Equation (11) is solved in a software system called PIP provided in WM 52 of FIG. 1. (See Appendix B for a detailed description of the method 206 for determining Pump Intake Pressure. PIP is an acronym for Pump Intake Pressure.) The basic idea of the PIP program is to use the subsurface pump to meter liquid and gas into the tubing (in well test amounts) at a pressure that satisfies eq. 11. Shrinkage is also considered 229 knowing that oil in the pump at $P_i$ has a larger volume than in the stock tank, because oil shrinkage occurs as gas separates from it while enroute from the pump to the stock tank. The PIP program uses "Nolen" non-dimensional curves for solution gas and oil shrinkage as functions of pressure. Such "Nolen" curves are illustrated in FIGS. 13, 14 and described in Appendix B. The PIP program assumes 300 a small starting value of $P_i$. It calculates 302 solution gas and shrinkage factor from the Nolen correlations. Then it computes 304 the volume of free gas at $P_i$ (initially) using eq.

$$\Delta V_g = \frac{\pi}{4} d^2 (S_g - S_n).$$

It then determines 306 total gas (as SCF) passing through the pump by adding free and solution gas volumes. This establishes 308 the tubing GLR (gas/liquid ratio). If multiphase flow considerations at this GLR do not produce 310 a $P_a$ which satisfies 312, 311 eq. 11, $P_i$ is increased 314 and the process is repeated. This process eventually defines the $S_{gas}$ needed to determine 224, 316 the correct $S_l$. Oil shrinkage can be found 302 from the Nolen correlation once $P_i$ is calculated.

According to the invention, the volumes of free gas 220, 305 and oil shrinkage 302, 229 are determined by running a PIP analysis for each generation of a pump card. A more direct iterative procedure based on Newton's method can be employed.

Using the WM to Infer Production Without the Need for Well Tests

As described above, assumptions which limit the accuracy of using the rod-driven down hole pump as a flow meter have been removed. According to the invention, the rod-driven down hole pump can accurately infer well production by removing prior assumptions, thereby eliminating the need for traditional well tests. Two examples are presented below which show the accuracy of inferred production according to the invention.

EXAMPLE 1

This illustration is taken from an actual well in West Texas

Figure 9A:
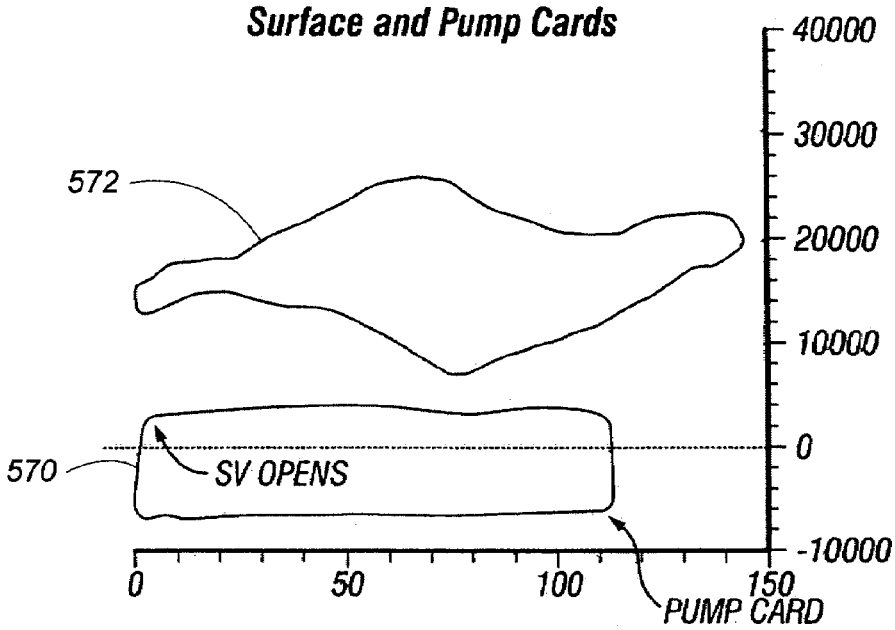
FIGS. 9A–9B illustrate a well which has a pump leakage with the pump card and pump velocity versus position graphs used to compute pump leakage.
Figure 9B:
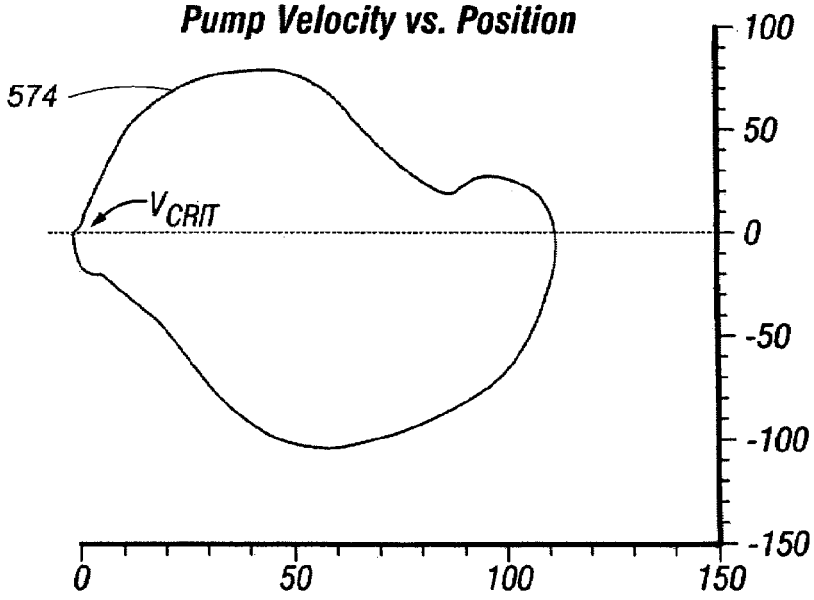

A new production test of 400 BFPD (35 BOPD plus 365 BWPD) was obtained on a well having a Well Manager System with an Inferred Production IP System. In a manual mode, IP indicated a production rate of 524 BFPD based on a previously determined k factor of 0.9. The difference of 124 BPD had to be explained. WM indicated that the well pumps continually, i.e. does not pump off. The dynamometer data used by WM for control was exported to a program named DIAG for extracting information from the pump card. The pump card 570 re-created by DIAG is shown in FIG. 9A which also shows the surface card 572. FIG. 9B shows the velocity plot 574 corresponding to the pump card 570. The pump card method (described above) was used to compute pump leakage. Evidence of leakage is present on the pump card 570, i.e. delayed load pickup and premature load release. Eq. 7 indicates that TV/plunger leakage is 64 BPD as follows $$L_{TV}=6.99d^2C_pV_{crit}=6.99(2.25)^2(0.53)\ (3.41)=64\ \text{BPD}.$$

The pump card 570 shows no evidence of a standing valve leak. The fluid load and net and gross strokes were measured from the pump card 570 and the PIP program was run. A pump intake pressure (see Equation 11) of 890 psi was indicated. An oil shrinkage factor of 1.234 was computed which means that the 35 BOPD of stock tank oil occupies a volume of 43 (35×1.234) BOPD at pump intake pressure. The accounting of fluid through the pump is then Gross pump capacity: 595 BPD (from the pump card)

Pump leakage: 64 BPD (from eq. 8)

Oil at pump conditions: 43 BPD (shrinkage effect computed by PIP)

Free gas: 0 BPD (no gas interference noted on pump card)

Produced water: 488 BPD (obtained by difference).

This accounting leads to a stock tank volume of 523 BFPD (35 BOPD plus 488 BWPD). Water shrinkage is not considered since gas does not dissolve appreciably in water. As a result of this investigation, the oil operator examined the metering equipment and found that the water measurement was incorrect and should have been 493 BWPD instead of 365 BWPD as reported. The new well test should have been 528 BFPD (35+493) which compares to the IP value of 524 BFPD based on a k factor of 0.9. Thus the IP system was within 4 BFPD of the actual measured production. It would be justified to adjust the k factor (where using the manual method) slightly to a new value of $$k = \frac{R_t}{R_{IP}} = \frac{528}{595} = 0.89.$$

But when the pump leakage and PIP routines are run automatically in WM, the k factor method of intermittently running a well test can be totally eliminated. In other words, complete determination of well production can be made without the need for traditional well tests.

EXAMPLE 2

The previous example shows, among other things, the uncertainties caused by an inaccurate well test and a severely worn pump. This example shows how the prior IP system can be improved for a gassy well with a good oil cut and a high pump intake pressure.

Figure 10A:
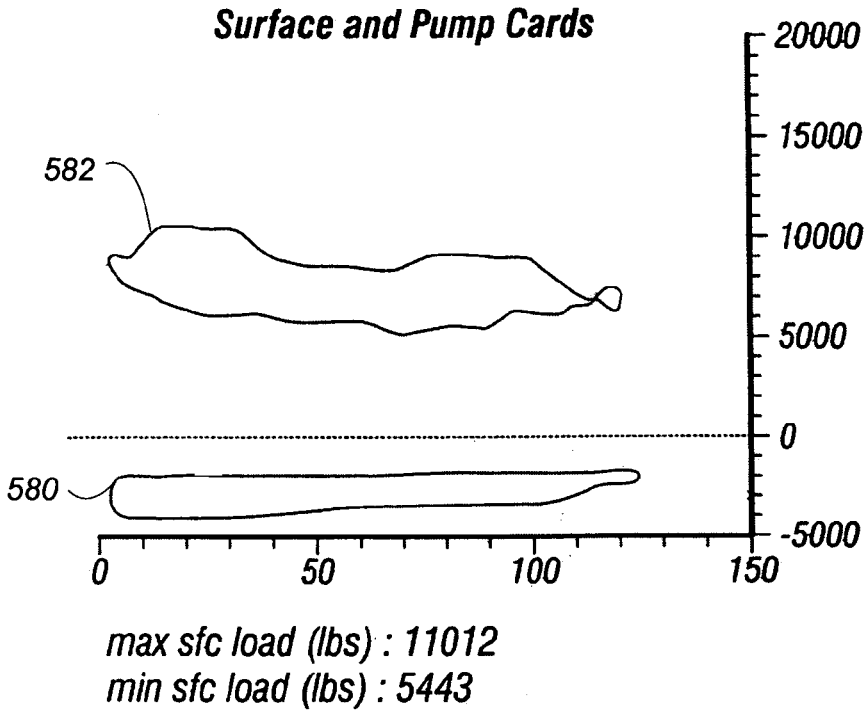
FIGS. 10A–10B illustrate a gassy well with high pump intake pressure.
Figure 10B:
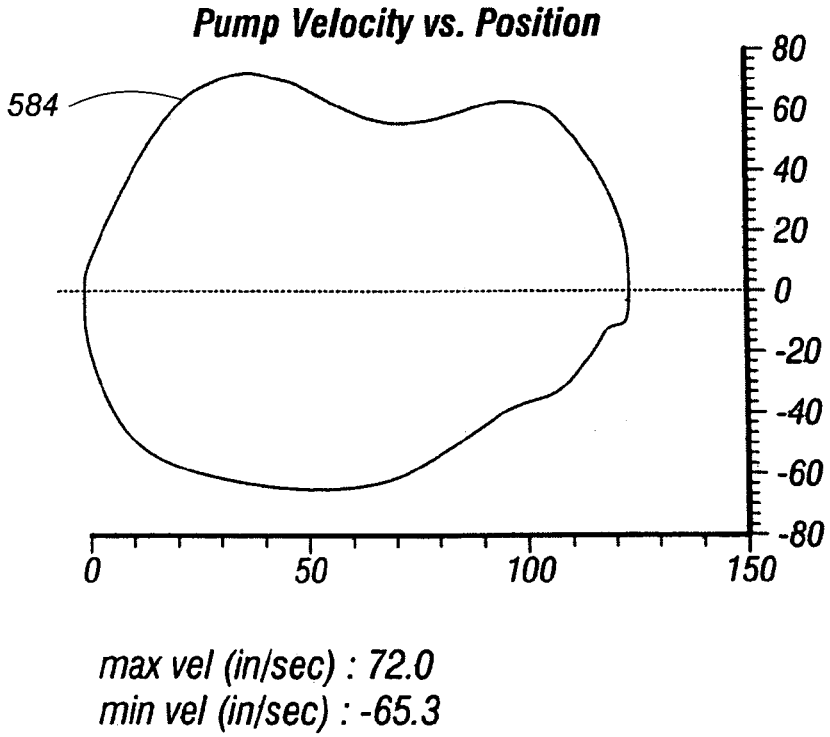

FIG. 10A shows the pump dynamometer card 580 and surface card 582 of such a well that is producing full-time. FIG. 10B shows a velocity plot 584 corresponding to pump card 580. Table I presented below for this example 2 is a PIP program analysis showing additional information that is available to IP according to the invention when the PIP program runs automatically in WM. The following accounting shows how the prior art IP system (unadjusted with a k factor) deals with the well.

Gross pump capacity: 457 BPD (from the pump card)

Net liquid (oil plus water): 395 BPD (from the pump card and Assumption 3, $S_n$=110.7

Free gas production: 62 BPD (by difference or eq. 4 extended to 24 hours).

Based on a reported well test of 277 BPD, a k factor of 0.7 would be indicated. This low factor, which is much less than 1, is a tip-off that the limiting assumptions are hurting the accuracy of IP.

The PIP program when incorporated into IP according to the invention yields a better accounting.

Gross pump capacity: 457 BPD (from the pump card)

Pump leakage: 10 BPD

Unanchored tubing: 5 BPD

Net liquid (oil plus water): 329 BPD (based on $S_l$ of 92.2 inches)

158 BOPD plus 129 BWPD at stock tank conditions (based on measured oil cut of 0.55)

Free gas production: 113 BPD (by difference). Assumption 3 is eliminated.

The IP system according to the invention produces a report 230 of liquid production at stock tank conditions comprising

158 BWPD

129 BOPD (based on the shrinkage factor of 1.266 computed by PIP)

287 BFPD total liquid.

This refined accounting, which does not include a k factor, compares with the traditional well test of 277 BFPD. The well test may or may not be exceedingly precise. This illustration shows that consideration of oil shrinkage is important in wells with a good oil cut and high producing pressure. It also shows the importance of computing (not neglecting) the volume of free gas in the pump when the traveling valve opens in wells with high producing pressure.

Figure 11:
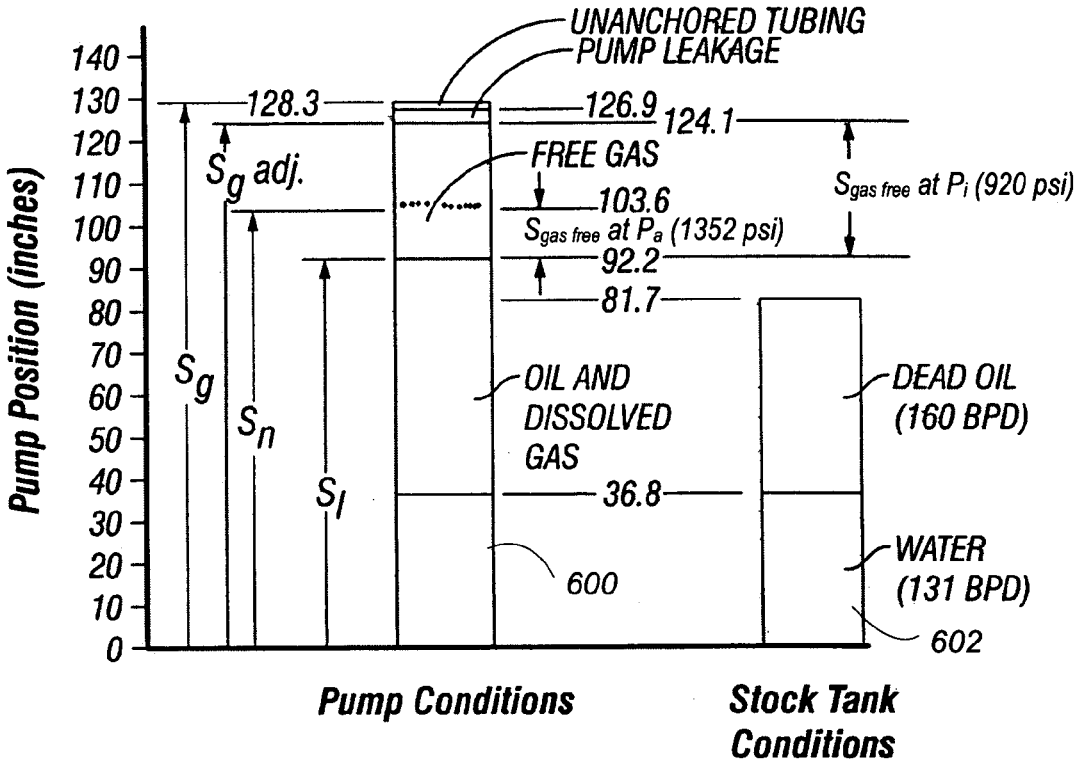
FIG. 11 illustrates the relationship among $S_g$, $S_{g\ adj}$, $S_n$, and $S_l$ with adjustments for unanchored tubing and pump leakage at pump conditions and the relationship of oil at stock tank conditions.

This example 2 illustrates the IP process as implemented by the invention incorporated in the PIP program. FIG. 11 illustrates the relationship among $S_l$, $S_n$, $S_{g\ adj}$, $S_{gas}$ at $P_i$, $S_{gas}$ at $P_a$, and $S_g$. The effect of oil shrinkage is also indicated by a comparison of the volume of fluid (oil and dissolved gas plus water) at pump conditions 600 and the volume of fluid (dead oil plus water) at stock tank conditions 602. The prior art PIP program did not determine pump leakage when calculating pump intake pressure, shrinkage, stock tank production, etc. An embodiment of the invention is provided for an improved PIP program that runs in WM 52 to handle valve leakage with accuracy.

The gross stroke in Table I below is taken to be 128.3 inches as also illustrated in FIG. 11 where pump positions are read from the pump card 580 (FIG. 10A) in inches from the bottom of the stroke. Differences in position signify portions of the gross stroke that represent gas, oil, water, pump leakage, unanchored tubing, etc.

The procedure 218 according to an embodiment of the invention is to subtract stroke segments representing unanchored tubing 204 and leakage 216 from the gross stroke. Then the pump intake pressure, shrinkage factor, and oil, water, and gas volumes in the pump on that stroke are determined. Finally, shrinkage is considered to compute stock tank oil and water volumes on that stroke.

TABLE I for Example 2
Pump Intake Pressure Program

| SUBSURFACE PUMP ANALYSIS | |
|---|---|
| Pump Bore Size (in): 1.75 | Setting Depth (ft): 4332 |
| Actual Pump Conditions ********** | |
| Pump Intake Pressure (psi): 920 | Pumping Speed (spm): 9.98 |
| Gross Stroke (in): 128.3 | Net Stroke (in): 92.2 |
| Gas Interference: MODERATE–SEVERE | Fluid Pound: None |
| Fluid Load (lbs): 1040 | Pump Leakage (bpd): 10 |

TABLE I-continued for Example 2
Pump Intake Pressure Program

| | |
|---|---|
| Crude Shrinkage Factor from Pump to Stock Tank (bbl per bbl): 1.266 | |
| Tubing Gas Liquid Ratio (cu ft per bbl): 272 | |

| Pump Volumetric Displacements | |
|---|---|
| Based on Net Stroke | Based on Adjusted Gross Stroke |
| 329 bpd (287 bpd @ Stock Tank Conditions) | 442 bpd |

| Pump Efficiencies | | |
|---|---|---|
| | Based on Test and Gross Stroke (percent) | Based on Test and Net Stroke (percent) |
| Crude Shrinkage not considered: | 62.6 | 84.3 |
| Crude Shrinkage considered: | 71.8 | 96.5 |

| OTHER DIAGNOSTIC INDICATORS | |
|---|---|
| Down Hole Friction: MODERATE | Lost Displacement (bpd): 5 |
| PUMP FRICTION | Avg Tbg Grad (psi per ft): .283 |
| Tubing or Annulus Check | |
| Valve Leak: None Likely | |
| Tubing Movement (in): 1.4 | |
| Tubinghead Pressure (psi): 125 | |
| Pump Power Without Slippage and Shrinkage (hp): 3.3 | |

| WELL TEST AND FLUID PROPERTY DATA | |
|---|---|
| Test Date: Apr. 29, 2003 | BOPD: 153 |
| BFPD: 277 | Oil Cut (%): 55.2 |
| BWPD: 124 | Test SPM: 9.98 |
| GOR: Unknown | Water Gravity (sg): 1.18 |
| Pumping Unit Stroke: 120.25 | Solution GOR (cu ft/bo): 640 est. |
| Oil Gravity (api): 38. | |
| Bubble Point (psi): 1760 est. | |
| Formation Volume Factor (bbl per bbl): 1.37 est. | |

APPENDIX A

From a down hole pump card, a single pump-slippage coefficient (usually estimated to be $C_p$=0.5) can be estimated from $$C_P = k\sum_{i=1}^{i=r}[0.5(F_i^P + F_{i+1}^P) - F_{\min}^P](t_{i+1} - t_i)$$

where $$k = \frac{1}{(F_{\max}^P - F_{\min}^P)\Theta}$$

$F_i^P$=pump loads used to construct pump card, lbf i=1, 2 . . . r $F_{max}^P$=maximum pump load, lbf $F_{min}^P$=minimum pump load, lbf Θ=pumping period, sec/cycle Alternatively, two pump slippage coefficients $C_{TV}$ and $C_{SV}$ can be defined. Such coefficients refer to traveling valve/plunger leakage and standing valve leakage. These can be defined as $$C_{TV} = k\sum_{i=1}^{i=r}[0.5(F_i^P + F_{i+1}^P) - F_{\min}^P](t_{i+1} - t_i) \quad 1$$

$$C_{SV} = k\sum_{i=1}^{i=r}[F_{\max}^P - 0.5(F_i^P + F_{i+1}^P)](t_{i+1} - t_i) \quad 2$$

where $$k = \frac{1}{(F_{\max}^P - F_{\min}^P)\Theta} \quad 3$$

The term $C_{TV}$ is a non-dimensional number that expresses the pressure difference across the traveling valve/plunger and the time of application of that pressure difference. Similarly $C_{SV}$ expresses the difference of pressure and time of application across the standing valve. Algebraic manipulation of eqs. 1, 2, and 3 provides that $$C_{TV}+C_{SV}=1$$

when it is recognized that $$\sum_{i=1}^{i=r} F_{\min}^P(t_{i+1} - t_i) = F_{\min}^P\Theta, \text{ etc.}$$

As seen above, a generic coefficient $C_p$ is used for $C_{TV}$. To save computer time by eliminating the need for calculating $C_{SV}$ the term $(1-C_p)$ is used when standing valve leakage is being computed. The sum of coefficients being unity results from the fact that both valves can not be open at the same time. The valves are frequently closed at the same time. An open valve can not leak, but a closed valve can. A closed valve leaks at a rate which is proportional to the pressure difference across it. The leakage coefficients defined above acknowledge the fact that a valve is closed part of the time and the pressure difference across it varies continually.

APPENDIX B

Method for Determining Pump Intake Pressure (PIP) Pump intake pressure is an important quantity in operating a rod pumped well. If this pressure is high, more production is available. If the pressure is low, little additional production is available at the present pump depth. Pump intake pressure also governs the volume of free gas in the pump and the amount of dissolved gas remaining in the oil. The quantity of dissolved gas affects the amount of shrinkage that the oil suffers in traveling up the tubing to the stock tank.

Using a wave equation derived pump card, the pump intake pressure in a well can be calculated with acceptable precision. The PIP procedure is described in the following stepwise procedure. The procedure determines $P_i$ subject to pressure balance considerations, multiphase flow concepts, and pressure-volume-temperature (PVT) characteristics of the produced oil, water and gas. Along with $P_i$ the PIP procedure computes oil shrinkage and liquid and gas passing through the pump.

Step 1. From multiphase flow (oil-water-gas) considerations, determine $P_a$ (psi) as a function of tubing gas/liquid ratio (GLR in SCF/bbl of liquid) 310. Denote this relationship as Table 1. SCF denotes gas in cubic feet at standard conditions of 14.65 psi and 520 deg R.

TABLE 1

| TRIAL $P_i$ | $P_a$ | GLR |
|---|---|---|

Step 2. Obtain a downhole pump card 212 using the wave equation. Identify fluid load $L_f$(lbs) 214, gross pump stroke $S_g$(inches) 214, net pump stroke $S_n$ (inches) 232 and tubing stretch $S_t$ (inches) 204 from the pump card.

Step 3. Using processes described herein, determine pump leakage (bpd) 202. Convert pump leakage to equivalent inches of stroke 216, $$\text{stroke} = \frac{bpd}{0.1166(d^2)(SPM)} \quad \text{B-1a}$$

in which stroke denotes the pump stroke, in this case lost by pump leakage ($S_{leakage}$), inches d denotes the diameter of the pump, inches SPM denotes the pumping speed of the surface unit, strokes per minute bpd denotes the volume of production corresponding to stroke, in this case lost by pump leakage, barrels per day.

Another version, $$bpd=0.1166(d^2)(SPM)(\text{stroke}) \quad \text{B-1b}$$

can be used to compute volume rate expressed in bpd using pump stroke expressed in inches. These relations can be used at will 305 to convert stroke increment into volume increment, and vice versa.

Step 4. Determine the adjusted gross stroke 218, $$S_{g\ adj}=S_g-S_t-S_{leakage} \quad \text{B-2}$$

Step 5. Conceptually, construct the pressure balance relationship 206 between $P_i$ and $P_a$, $$P_i = P_a - \frac{L_f}{A_p} \quad \text{B-3}$$

where $P_i$ is pump intake pressure below the standing valve, psia $P_a$ is the pressure above the pump at the foot of the tubing caused by tubing head pressure and hydrostatic pressure effects of oil, water and gas in the tubing above the pump, psia. This can also be called pump outlet pressure.

$L_f$ is the fluid load read from the pump card, lbs $A_p$ is the plunger area of the down hole pump, in.

Figure 12:
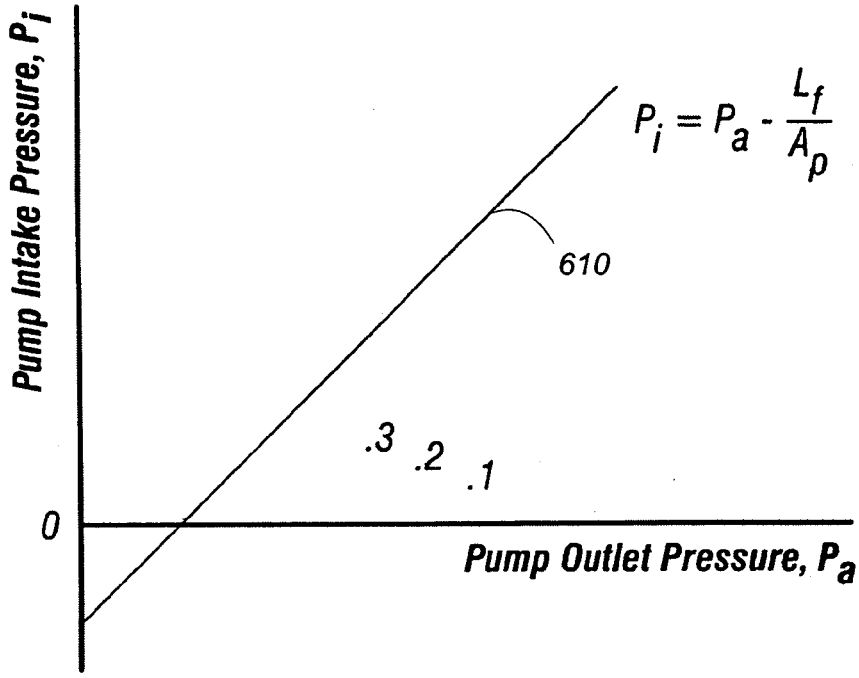
FIGS. 12, 13, and 14 illustrate a method for determination of pump intake pressure and corresponding shrinkage factor of Gas Oil Ratio remaining in solution.

Refer to FIG. 12 where the $P_i$ is plotted as a function of $P_a$. True $P_i$ lies somewhere on the straight line 610 of FIG. 12.

Step 6. Assume a low trial $P_i$ 300.

Step 7.

a) Compute the oil shrinkage factor $F_{shrinkage}$ and the gas remaining in solution (SCF/bbl of oil) at the trial $P_i$ 302.

b) Using gas laws, compute $S_{gas}$ based on the trial $P_i$ 318. Compute $S_l$ 316 from $$S_l=S_n-S_{gas}$$

c) Determine oil cut at pump conditions from the shrinkage factor and measured oil cut at surface conditions 320.

d) Determine the instantaneous BOPD and BWPD at trial $P_i$ using oil cut at pump conditions, $S_l$ and eq. B-1 322. Instantaneous rate is the rate on the stroke in question.

e) Determine free gas volume (SCF/day) 220, 305 at trial $P_i$ using gas equations, eq. B-1 and $S_{free\ gas}=S_{g\ adj}-S_l$ 304.

f) Determine dissolved gas volume (SCF/day) at trial $P_i$ using the BOPD and gas remaining in solution 326.

g) Determine total gas (SCF/day) passing through pump into tubing by adding free gas volume to dissolved gas volume 306.

h) Determine tubing GLR 308 from $$GLR = \frac{\text{total gas}}{BOPD + BWPD}$$

Step 8. Using Table 1 created in Step 1, determine $P_a$ corresponding to trial $P_i$ 310 using the GLR computed above in Step 7. Conceptually plot this $P_a$ (which corresponds to the trial $P_i$) as point 1 on FIG. 12. If point 1 does not fall on (or close enough to) the straight line pressure balance relationship 311, the true $P_i$ has not been found. Change the trial $P_i$ 314 and return to Step 7. Repeat this process until the true $P_i$ is found 312.

As the trial $P_i$ is increased, the corresponding $P_a$ will decrease. This results because more gas is computed to be entering the tubing which diminishes the hydrostatic pressure effect, hence $P_a$. The line drawn through trials points 1, 2, 3, . . . . will intersect the pressure balance line to reveal the true $P_i$ 328. The convergence process can be sped up using Newton's Method to select new trial $P_i$ values. The process described herein uses trial $P_i$ values spaced equal pressure increments apart.

After the pump intake pressure $P_i$ has been finally determined use non-dimensional curves 620, 630 of FIGS. 13 and 14, respectively, to determine oil shrinkage factor and GOR remaining in solution that correspond to the $P_i$ 302.

Step 9. Determine stock tank liquid and tubing gas production increments using the oil shrinkage factor 302, BOPD, BWPD 322, free and dissolved gas volumes 305, 326 corresponding to the true $P_i$ found in Step 8.

The invention claimed is:

1. A method for managing production of a rod pumped well by using a subsurface pump (44) as a meter comprising the steps of, generating a down hole pump card (212) from surface load and position measurements (208, 210) of a rod pumping unit (10), determining a position of traveling valve (TV) opening (214) from said down hole pump card;

determining from said down hole pump card a stroke distance $S_n$ (232) traveled by said plunger from said position of TV opening to a bottom of the stroke, determining the volume of free gas $\Delta V_{gas}$ (220) remaining in the pump at TV opening, determining a distance $S_{gas}$ (222) of the stroke distance $S_n$ that corresponds to the volume of free gas $\Delta V_{gas}$ remaining in the pump at TV opening, determining a distance $S_l$ (224) of the stroke distance that corresponds to the liquid stroke distance in the pump at TV opening from the equation, $S_l=S_n-S_{gas}$, determining net liquid production (226) at pump pressure and temperature for said pumping cycle from the equation, $$\Delta V_1 = \frac{\pi}{4} d^2 S_l$$

where $\Delta V_1$ is net liquid production measured in cubic dimension at the pump, d is the diameter of the pump measured in length dimension, and $S_l$ is measured at the pump in length dimension, converting $\Delta V_l$ (228) at pump conditions to stock tank conditions, and producing a report of liquid production of said well (230).

2. The method of claim 1 further comprising the steps of identifying fluid load $L_f$ (lbs) (214), gross pump stroke $S_g$(inches) (214), and tubing stretch $S_t$ (inches) (204) in addition to said net pump stroke $S_n$ (inches) from said pump card, determining leakage in equivalent inches of stroke (216), $$S_{leakage} = \text{stroke(inches)} = \frac{bpd}{0.1166(d^2)SPM}$$

where $S_{leakage}$=pump stroke lost by pump leakage

SPM=pumping speed, stroke per minute bpd=volume production lost by pump leakage, barrels per day determining adjusted gross stroke (218), $$S_{g\ adj}=S_g-S_t-S_{leakage},$$

iteratively solving a pump intake pressure equation (206), $$P_i = P_a - \frac{L_f}{A_p}$$

where, $P_i$=pump intake pressure $P_a$=pressure above the pump plunger due to tubing head pressure and hydrostatic effects of oil-gas-water in the tubing $L_f$=fluid load derived from pump card $A_p$=area of plunger by (a) first assuming a low-trial $P_i$, $P_{i\ start}$ (300), (b) calculating an oil shrinkage factor $F_{shrinkage}$ and the gas remaining in solution (SCF/bbl of oil) at $P_{i\text{-}start}$ (302), (c) computing the distance $S_{gas}$ using gas laws based on $P_{i\ start}$ pressure (318), (d) computing $S_l$ (316) from $$S_l=S_n-S_{gas},$$

(e) determining oil cut at pump conditions (320) from shrinkage factor $F_{shrinkage}$ and measured oil cut at surface conditions, (f) determining BOPD and BWPD at $P_{i\ start}$ (322) using oil cut at pump conditions, $S_l$ and $$\text{pump stroke} = \frac{bpd}{0.1166(d^2)(SPM)}$$

(g) determining free gas equivalent stroke (304), $$S_{free\ gas}=S_{g\ adj}-S_l,$$

(h) determining dissolved gas volume (SCF/day) (326) at $P_{i\ start}$ using BOPD and gas remaining in solution, (i) determining total gas (SCF/day) (306) passing through the pump into tubing by adding free gas volume to dissolved gas volume, (j) determining tubing Gas Liquid Ratio, GLR, (308) from $$GLR = \frac{\text{total gas}}{BOPD + BWPD},$$

(k) determining $P_{a\ start}$ from said GLR (310), (l) determining $P_{a\ cal}$ (311) from said pump intake pressure equation, $$P_{a\,cal} = P_{i\,start} + \frac{L_f}{A_P}$$

(m) determining if $P_{a\ start}=P_{a\ cal}$ (312), (n) if so, $P_{i\ n}=P_{i\ start}$ (328), if not, increasing $P_i$ start (314) and repeating steps (b) through (m) with $P_{i\ n}$ where $P_{i\ n}$ is an nth iteration until $P_{a\ cal}=P_{a\ n}$, and $P_{i\ true}$ is equal to $P_{i\ n}$, (o) determining $\Delta V_{gas}$ (220) from $P_{i\ true}$, and (p) determining said $S_{gas}$ (222) from $\Delta V_{gas}$ from, $$\Delta V_{gas} = \frac{\pi}{4} d^2 S_{gas}$$

where $\Delta V_{gas}$ is measured in cubic dimensions at pump conditions d is the diameter of the pump measured in length dimensions $S_{gas}$ is measured in length dimensions.

3. The method of claim 1 further comprising the step of calculating inferred daily liquid production rate (228) in barrels per day from the equation, $$R_{IP} = \frac{8.905 \sum \Delta V_I}{T_P + T_d}$$

where $R_{IP}$ is inferred daily production rate in barrels per day at stock tank conditions $T_P$ is the cumulative producing time in a day $T_d$ is the cumulative down time in a day, if any, and each $\Delta V_1$ corresponds to a known instantaneous intake pressure $P_i$.

4. The method of claim 3 further comprising the step of determining daily free gas rate (200) in standard cubic dimension per day is determined from the equation $$G_{IP\,free} = \frac{50}{T_p + T_d}\left(\frac{P_i}{P_s}\right)\left(\frac{z_s}{z_i}\right)\left(\frac{T_s}{T_i}\right)\sum \Delta V_{gas}$$

where $P_i$, $z_i$, $T_i$ are pressure, compressibility and temperature at pump intake conditions, $P_s$, $z_s$, $T_s$ are pressure, compressibility and temperature at standard conditions, and $\Delta V_{gas}$ is measured on each stroke of the pump while instantaneous $P_i$ is known, in standard cubic dimensions.

5. The method of claim 1 further comprising the steps of determining Traveling Valve (TV)/plunger leakage $L_{TV}$ rate (202) for said pumping cycle, and determining net liquid production (227) from the equation $$\Delta V_{net}=\Delta V_I-(L_{TV})(T)$$

where T is the cycle time of said pumping cycle.

6. The method of claim 5 wherein said step of determining Traveling Valve/plunger leakage $L_{TV}$ for said pumping cycle is derived by finding $V_{crit}$ by observing an increase in pump velocity (406) from said pump card and from the equation (408), $$L_{TV}=6.99d^2C_pV_{crit}$$

where $C_p$ is a coefficient derived from the pump card d is the pump diameter measured in length dimension, and $V_{crit}$ is the pump velocity at standing valve opening measured in velocity dimension, and $L_{TV}$ is leakage rate of the TV/plunger assembly in BPD.

7. The method of claim 5 wherein, said step of determining Traveling Valve/plunger leakage $L_{TV}$ for said pumping cycle is determined by the sub-steps of observing the rod string slowing down (428) and determining $L_{TV}$ (412) from the equation $$L_{TV}=6.99d^2C_pV_{crit}$$

where $C_p$ is a coefficient derived from the position curve d is the pump diameter is measured in length dimension $V_{crit}$ is the pump velocity at standing valve closing.

8. The method of claim 5 wherein, said step of determining Traveling Valve/plunger leakage $L_{TV}$ for said pumping cycle is determined by the sub-steps of observing a maximum load loss rate of the traveling valve (432), and determining $L_{TV}$ (434) from the equation $$L_{TV} = 6.99\, d^2 C_p k_{rt}\left(\frac{dF}{dt}\right)_{\max}$$

where $L_{TV}$ is the leakage rate of the TV/plunger assembly $k_{rt}$ is the combined stretch constant for the rod string and unanchored tubing and $$\left(\frac{dF}{dt}\right)_{\max}$$

is the maximum rate of traveling valve load loss (lb/sec).

9. The method of claim 8 wherein standing valve leakage is determined (436) from the surface load curve, and the equation $$L_{SV} = 6.99d^2(1 - C_P)K_{rt}\left(\frac{dF}{dt}\right)_{\max}$$

where $$\left(\frac{dF}{dt}\right)_{\max}$$

is the maximum rate of traveling valve load increase $$\left(\frac{\text{lb}}{\text{sec}}\right).$$

10. A method for managing a rod pumped well by using the subsurface pump (44) as a meter comprising the steps of, generating a down hole pump card (212) from surface load and position measurements (208, 210) of a rod pumping unit (10), determining the gross stroke $S_g$ (214) of the plunger of the subsurface pump (44) which pumps oil, water and gas to the surface via a production tube, where gross stroke $S_g$ is the distance measured from the lowest position where the Traveling Valve TV closes to the highest position where the standing valve SV closes, identifying a characteristic of unanchored tubing by determining a distance $S_t$ (204) between TV closure to SV opening on said pump card, determining a distance $S_n$ (232) as the distance traveled by the pump from TV opening to the bottom of the stroke from the equation $$S_n = S_g - S_t,$$

determining liquid production for said pumping cycle (226) from the equation $$\Delta V_l = \frac{\pi}{4} d^2 S_l,$$

where $\Delta V_l$ is measured in cubic dimension d is the diameter of the pump measured in length dimension, and $S_l$ is measured in length dimension, and producing a report of liquid production of said well (230).

11. A method for managing a rod pumped well by using the subsurface pump (44) as a meter comprising the steps of, generating a down hole pump card (212) from surface load and position measurements (208, 210) of a rod pumping unit (10), determining the gross stroke $S_g$(214) of the plunger of the subsurface pump (44) which pumps oil, water and gas to the surface via a production tube, where gross stroke $S_G$ is the distance measured from the position where the traveling valve TV closes to the position where the standing valve SV closes, determining fluid load (214) from said pump card, determining tubing stretch (204) from the equation $$S_t = K \frac{L_f D_p}{E_t A_t}$$

where $S_t$ is tubing stretch in length dimension

K is a dimensional constant $L_f$ is fluid load in lb $D_p$ is the pump setting depth in length dimension $E_t$ is the modulus of elasticity of the tubing (Psi)

$A_t$ is the cross sectional area of the tubing (area dimension), determining a distance $S_n$ (232) as the distance traveled by the pump from TV opening to the bottom of the stroke from the equation, $$S_n = S_g - S_t,$$

determining liquid production (226) for said pumping cycle from the equation $$\Delta V_l = \frac{\pi}{4} d^2 S_l,$$

where $\Delta V_l$ is measured in cubic dimension d is the diameter of the pump measured in length dimension, $S_l$ is measured in length dimension, and producing a report of liquid production of said well (230).

12. A method for managing a rod pumped well by using the subsurface pump (44) as a meter comprising the steps of, generating a down hole pump card (212) from surface load and position measurements (208, 210) of a rod pumping unit (10), determining the position of traveling valve (TV) opening (214) of said pump from said down hole pump card, determining the distance $S_l$ (224) of the stroke distance of said pump that corresponds to the liquid stroke in the pump at TV opening, determining traveling valve (TV)/plunger leakage $L_{TV}$ rate (202) for said pumping cycle, determining liquid production (226) for said pumping cycle from the equation $$\Delta V_l = \frac{\pi}{4} d^2 S_l$$

where $\Delta V_l$ is measured in cubic dimension d is the diameter of the pump measured in length dimension, $S_l$ is measured in length dimension, determining net liquid production (227), $$\Delta V_{net} = \Delta V_l - L_{TV}(T)$$

where T is the cycle time of said pumping cycle, and producing a report of liquid production of said well (230).

13. The method of claim 12 further comprising the step of inferring daily liquid production rate (228) in barrels per day from the equation, $$R_{IP} = 8.905 \frac{\sum \Delta V_l}{T_P + T_d}$$

where $R_{IP}$ is inferred daily production rate in barrels per day, and $T_p$ is the cumulative producing time in a day, $T_d$ is the cumulative down time in a day, if any.

* * * * *